US006019056A

United States Patent [19]

Maeda et al.

[11] Patent Number: 6,019,056

[45] Date of Patent: Feb. 1, 2000

[54] ANTI-ROLLING APPARATUS

[75] Inventors: Toru Maeda, Tochigi; Takeshi Hojo, Kuroiso; Michio Fukano; Naoki Sakuraoka, both of Ohtawara; Isao Masuzawa, Kuroiso, all of Japan

[73] Assignee: Tokimec Inc., Japan

[21] Appl. No.: 08/956,679

[22] Filed: Oct. 23, 1997

[30] Foreign Application Priority Data

| | | | |
|---|---|---|---|
| Oct. 23, 1996 | [JP] | Japan | 8-280843 |
| Oct. 31, 1996 | [JP] | Japan | 8-290602 |
| Oct. 31, 1996 | [JP] | Japan | 8-290603 |
| Oct. 31, 1996 | [JP] | Japan | 8-290604 |

[51] Int. Cl.[7] ..... B63B 39/02

[52] U.S. Cl. ..... 114/122; 114/124

[58] Field of Search ..... 114/121, 122, 114/123, 124, 125

[56] References Cited

U.S. PATENT DOCUMENTS

| | | | |
|---|---|---|---|
| 3,083,671 | 4/1963 | Ripley | 114/124 |
| 3,397,664 | 8/1968 | Slager et al. | 114/124 |
| 5,713,163 | 2/1998 | Mutaguchi et al. | 114/124 |

*Primary Examiner*—Stephen Avila
*Attorney, Agent, or Firm*—Bauer & Schaffer, LLP

[57] ABSTRACT

An anti-rolling apparatus according to the present invention includes rail members which are formed in straight form and disposed perpendicular to a rolling axis of an object whose rolling is to be reduced, a movable weight capable of reciprocating along the rail members, and two springs for generating a stability force for the movable weight, wherein the two springs are elongated or contracted alternately when the movable weight is reciprocated.

17 Claims, 25 Drawing Sheets

ANTI-ROLLING APPARATUS

BACKGROUND OF THE INVENTION

1. Field of the Invention

This invention relates to an anti-rolling apparatus for reducing a rolling of an object whose rolling is to be reduced, and more particularly to dynamic vibration reducer type anti-rolling apparatus constructed so as to reduce a rolling of the object by a movable weight which reciprocates along a rail. The objects whose rolling is to be reduced include ships in stoppage condition, marine structures floating on the sea or water such as barge, and structure hoisted in the air such as lift, gondola and the like.

2. Description of the Related Art

Since before as the anti-rolling apparatus for reducing a rolling of the object, an active type apparatus using an actuator and a passive type apparatus using a dynamic vibration reducer principle have been known. The active type apparatus detects a rolling of the object by means of a sensor and vibrates a movable weight by means of an actuator. The vibration of the movable weight is controlled in terms of phase so as to reduce the rolling of the object. Further, some type apparatus produces an anti-rolling effect by using a torque depending on gyro effect.

On the other hand, the passive type apparatus using the dynamic vibration reducer principle is simple in structure because it does not utilize an actuator for driving the movable weight, and is widely applicable because it does not consume much electricity.

Referring to FIG. 1, an example of a conventional anti-rolling apparatus using the dynamic vibration reducer principle will be described. This example was disclosed in Japanese Patent Application No. H8-15428 filed in Jan. 31, 1996 by the same applicant as this invention.

This anti-rolling apparatus comprises a rail member 511 curved in a circular shape, a movable weight 512 capable of moving freely along the rail member 511 and supporting members 513A, 513B located on both sides. Horizontal shafts 511A, 511B are mounted on both ends of the rail member 511 and the horizontal shafts 511A, 511B are rotatably supported by bearings (not shown) in the supporting members 511A, 511B.

The supporting members 513A, 513B are mounted vertically on a predetermined base 514 of a marine structure. Thus the horizontal shafts 511A, 511B are parallel to the base 514. As shown in the Figure, x-axis is set along the horizontal shafts 511A, 511B on a plane parallel to the base 514, y-axis is set perpendicular to the x-axis and then z-axis is set perpendicular to the base 514.

This anti-rolling apparatus is so constructed as to reduce a rolling around a rotary axis parallel to the y-axis of the marine structure. When the marine structure rolls around the rotary axis parallel to the y-axis, the movable weight 512 reciprocates along the rail member 511. The movable weight 512 reciprocates on the circular path along the rail member 511. A component of force of the gravity becomes a restoring force for the reciprocating motion. A center of the vibration of the movable weight 512 is a center of the circular path, which is located at the lowest point.

The vibration of the marine structure is reduced by the reciprocating motion of the movable weight 512. For the anti-rolling apparatus to function effectively, the reciprocating motion of the movable weight 512 needs to have the same oscillation cycle as the oscillation cycle of a marine structure and further a phase deviated by only a predetermined angle or displacement with respect to the phase of the marine structure.

Generally, the oscillation cycle of the marine structure is governed by the natural oscillation cycle of the marine structure. The natural oscillation cycle of the marine structure is determined depending on a structure, mass, gravity center, and the like of the marine structure, and differs depending on the marine structure. If freight or the like is changed, the mass, gravity center and the like are changed, so that the natural oscillation cycle is also changed.

On the other hand, the oscillation cycle of the movable weight is governed by the natural oscillation cycle of the movable weight 512. The natural oscillation cycle of the movable weight 512 is determined depending on the mass, motional path and the like of the movable weight 512. To obtain a desired anti-rolling effect, it is necessary to make the natural oscillation cycle of the movable weight 512 substantially match with the natural oscillation cycle of the marine structure.

The anti-rolling apparatus shown in FIG. 1 is so constructed that the natural oscillation cycle of the movable weight 512 in the anti-rolling apparatus can be adjusted. Even if the freight or the like on the marine structure is changed, so that the natural oscillation cycle is changed, the desired anti-rolling effect can be obtained by adjusting the natural oscillation cycle of the movable weight 512 in the anti-rolling apparatus.

In this example, the rail member 511 can be rotated around the horizontal shafts 511A, 511B. Consequently, the movable weight 512 moves along the rail member 511 on a plane inclined relative to the x-z plane.

An external force originating from a vibration of the marine structure and gravity act upon the movable weight 512. A force which contributes for the motion of the movable weight 512 is a component in the direction of motion of the movable weight 512 or a component in the direction of tangent line on a central axis of the rail member 511.

The restoring or stability force of the reciprocating motion of the movable weight 512 is based on the gravity. For example, assuming that an angle formed by a tangent line on the central axis of the rail member 511 relative to vertical line is $\alpha$, the restoring force is $mg\cos\alpha$.

When the rail member 511 rotates around the horizontal shafts 511A, 511B, $\cos\alpha$ is reduced thereby reducing the restoring force. As a result, the natural oscillation cycle of the movable weight 512 increases.

Therefore, when the natural oscillation cycle of the marine structure is increased due to a change of freight or the like, the rail member 511 is rotated around the horizontal shafts 511A, 511B so as to increase the natural oscillation cycle of the movable weight 512, thereby achieving a desired anti-rolling effect.

The conventional anti-rolling apparatus shown in FIG. 1 utilizes the rail member 511 which is curved in a circular shape. Production of the curved rail member 511 at a high precision is very difficult, therefore mass production thereof could not be carried out. To process the rail member 511 in accurate circular shape, the production cost increases.

In the conventional anti-rolling apparatus, because the rail member 511 formed in a circular shape is used, a volume occupied by the anti-rolling apparatus, particularly a portion for incorporating the rail member 511 and the movable weight 512 are enlarged. Particularly when this apparatus is loaded on a small size ship or the like, sometimes it could not be loaded thereon.

In the conventional anti-rolling apparatus, the natural oscillation cycle of the movable weight 512 could not be reduced although it could be increased.

A conventional anti-rolling apparatus using the dynamic vibration reducer principle will be described with reference to FIG. 2. This anti-rolling apparatus comprises a rail member 520 having a rail face 521 curved in a circular shape, a movable weight 522 capable of moving freely on the rail face 521 and an electric conductor member 530 curved in a circular shape parallel to the rail face 521.

The movable weight 522 has a pair of wheels 523 each on the front and rear portions. On both ends of the rail face 521 are provided stoppers 521A, 521B for specifying a stroke of the movable weight 522.

A construction and operation of a magnetic damper provided on the anti-rolling apparatus shown in FIG. 2 will be described with reference to FIG. 3. The movable weight 512 has a concave portion 522A, so that it has U-shaped cross section. On an internal face of this concave portion 522A are mounted a pair of permanent magnets 532, 532. As shown in this Figure, the permanent magnets 532, 532 are disposed on both sides of a sheet-like electric conductor member 530 with a slight gap.

The electric conductor member 530 and the permanent magnets 532, 532 form the magnetic damper. The electric conductor member 530 is made of electric conductive material such as copper and the movable weight 522 is made of metal having a small magnetic resistance such as iron. As shown by an arrow M, a magnetic path passing the movable weight 522, the permanent magnets 532, 532 and the electric conductor member 530 on the U-shaped cross section, is formed.

Magnetic flux generated by the permanent magnets 532, 532 passes through the electric conductor member 530. When the movable weight 522 moves along a rail surface 521, magnetic flux passing the electric conductor member 530 is moved, so that eddy current is generated in the electric conductor member 530 sandwiched by the permanent magnets 532, 532 because of Fleming's rule. Because of this eddy current, a braking force is applied to the movable weight 522 supporting the permanent magnets 532, 532. This braking force acts as a damping force for the reciprocating movable weight 522.

The magnetic damper has the following characteristics.

(1) The damping force is accurately proportional to a speed of motion of the movable weight 522. (2) There is no mechanical contacting component thereby causing no friction, and therefore an excellent durability is ensured. (3) The damping force less depends on temperature.

A restoring force applied to the movable weight 522 will be described with reference to FIG. 4. Assume that if the movable weight 522 reciprocates along the rail face 521, the gravity center G of the movable weight 522 reciprocates on a circle in which a center thereof is O' and a radius is R. As shown in the Figure, the lowest point of a tracing of the gravity center G is designated as an origin O and x-axis is set horizontally and y-axis is set vertically. Further, z-axis is set perpendicular to the x-axis and y-axis (perpendicular to the paper sheet). This anti-rolling apparatus is so constructed as to reduce a rolling around a rotary axis parallel to the z-axis of the object.

When the movable weight 522 reciprocates along the rail face 521, a component in the direction of tangent line applied to the movable weight 522 acts as a restoring force. For example, assuming that a displacement of the gravity center G of the movable weight 522 is x and an angle formed by a radius O'G of the circle and a vertical line (Y-axis) is $\alpha$, a component of the gravity in the direction of tangent line is mgsin $\alpha$=(mg/R)x and proportional to the displacement x of the movable weight 522.

A restoring force (mg/R)x caused by the gravity and a damping force by the magnetic damper act on the movable weight 522. Therefore, an equation of motion of the movable weight 522 can be expressed as follows.

$$m(d^2x/dt^2)+C(dx/dt)+kx=P \quad (1)$$

where k=mg/R, C is a damping coefficient by the magnetic damper, and P is an external force caused by oscillation of the object.

Generally, for the anti-rolling apparatus to generate an optimum anti-rolling operation for an object whose oscillation is to be reduced, the vibration cycle of the movable weight 522 needs to coincide with that of the object and at the same time, the oscillations of both need to be displaced with respect to each other by a predetermined difference of phase. For example, if an oscillation angle of the object is increased so that the movable weight 522 strikes stoppers 521A, 521B on both ends, a relation in phase between both is deteriorated so that a desired anti-rolling effect cannot be obtained. Thus, it is necessary to limit a stroke of reciprocation of the movable weight 522 for the movable weight 522 not to strike the stoppers 521A, 521B.

For the movable weight 522 not to strike the stoppers 521A, 521B, the damping force by the magnetic damper is increased sufficiently so as to limit the stroke. However, if the damping force of the movable weight 522 is increased, when a rolling angle of the object is small, a desired anti-rolling effect cannot be obtained.

Thus, it is desirable that when the rolling angle of the object is large, the damping force is sufficiently large for the movable weight 522 not to strike the stoppers on both ends and when the rolling angle of the object is small, the damping force is sufficiently small so as to obtain a sufficient anti-rolling effect for the object.

Generally, the damping force by the magnetic damper is proportional to a speed of the movable weight 522. Thus, the speed of the movable weight 522 is decreased on both ends of the oscillation thereof, so that the damping force is small. Because the speed of the movable weight 522 in the vicinity of the origin O is increased, the damping force is large.

However, the magnetic damper used in the conventional anti-rolling apparatus shown in FIGS. 2, 3 could not adjust the damping force depending on the rolling angle of the object. For example, the damping coefficient C in the second term of the left part of an expression shown in Expression 1 is constant.

In an anti-rolling apparatus of passive dynamic vibration reduction type, an inertia force applied to the movable weight 522 varies depending on an installation height, so that the anti-rolling effect is changed. For example, as the installation height for the anti-rolling apparatus increases with respect to the rolling center of the object, the inertia force acting on the movable weight 522 also increases. As the installation height for the anti-rolling apparatus decreases, the inertia force acting on the movable weight 522 also decreases.

Therefore, in order to prevent the movable weight 522 from striking the stoppers 521A, 521B or limit the stroke thereof, it is necessary to increase the damping force as the installation height for the anti-rolling apparatus is increased with respect to the rolling center of the object and decrease the damping force as the installation height of the anti-rolling apparatus is decreased.

However, in the magnetic damper used in the conventional anti-rolling apparatus shown in FIGS. 2, 3, even if the installation height for the anti-rolling apparatus differs, the damping force by the magnetic damper cannot be adjusted and therefore is constant.

SUMMARY OF THE INVENTION

Accordingly, an object of the present invention is to provide an anti-rolling apparatus which can be produced easily and at low production cost.

Another object thereof is to provide an anti-rolling apparatus which can be loaded on a small ship because a volume occupied thereby is small.

Still another object thereof is to provide an anti-rolling apparatus capable of changing the natural oscillation cycle easily.

An object of the present invention is to provide an anti-rolling apparatus constructed such that the deterioration of a desirable phase relation between the movable weight and the anti-rolling object can be reduced even when a swinging angle of the anti-rolling object is large and the movable weight hits against the shock absorbers at both ends of an orbit.

Another object of the present invention is to provide an anti-rolling apparatus constructed such that a desirable phase relation between the movable weight and the anti-rolling object can be maintained even when a swinging angle of the anti-rolling object is large and the vibration of the movable weight is limited at both ends of an orbit.

Accordingly, an object of the present invention is to provide a halt/fixing device capable of effectively halting and fixing a movable weight.

Another object thereof is to provide an anti-rolling apparatus containing a halt/fixing device capable of effectively halting and fixing the movable weight.

An object of the present invention is to provide an anti-rolling apparatus so constructed that when a rolling angle increases, a damping force also increases and when the rolling angle decreases, the damping force also decreases.

Another object of the present invention is to provide an anti-rolling apparatus capable of adjusting a damping force by a magnetic damper.

According to one aspect of the present invention, there is provided an anti-rolling apparatus comprising rail members which are formed in straight form and disposed perpendicular to a rolling axis of an object whose rolling is to be reduced, a movable weight capable of reciprocating along the rail members, and two springs for generating a stability force for the movable weight, wherein the two springs are elongated or contracted alternately when the movable weight is reciprocated.

According to another aspect of the present invention, there is provided an anti-rolling apparatus wherein when one of two springs is elongated, the other thereof is contracted. According to still another aspect of the present invention, there is provided an anti-rolling apparatus wherein the two springs are disposed in parallel to the rail members and the movable weight has incorporating portions for incorporating the springs. According to a further aspect of the present invention, there is provided an anti-rolling apparatus wherein two wires are connected to the movable weight and the two springs are connected to the other ends of the wires such that the wires are guided by means of roller members.

According to a still further aspect of the present invention, there is provided an anti-rolling apparatus wherein a natural oscillation cycle of the movable weight can be changed by changing spring constants of the two springs. According to a still further aspect of the present invention, there is provided an anti-rolling apparatus further comprising shock absorbers for relaxing a shock which may occur when the movable weight is forcibly stopped.

An anti-rolling apparatus in the present invention comprises a movable weight able to be reciprocated along a predetermined rail member, a restoring force generator for generating restoring force of the movable weight, and springs for stoppers arranged at both ends of said rail member, and is constructed such that kinetic energy of said movable weight is accumulated by the springs for stoppers.

In the anti-rolling apparatus of the present invention, said restoring force generator includes a spring connected to said movable weight. Buffer rubbers are arranged at both the ends of said orbit. Further, a damper for generating damping force of said movable weight is arranged.

According to the present invention, there is provided an anti-rolling apparatus comprising a rail member supported by supporting members, a movable weight capable of reciprocating along the rail member, a restoring force generating device for generating a restoring force for the movable weight, and a halt/fixing device for halting and fixing the movable weight, wherein the halt/fixing device contains a brake hinge mounted on the movable weight and slide supporting member which is mounted on the supporting members and disposed so as to extend along the rail member, the brake hinge being moved between a friction engagement position in which it fictionally engages with the rail member and a friction releasing position in which the frictional engagement with the rail member is released, by moving the slide supporting member.

Further, according to the present invention, there is provided an anti-rolling apparatus wherein the brake hinge is capable of pivoting around a pivoting shaft and contains a first friction material for fictionally engaging with the rail member and a second friction material for fictionally engaging with the slide supporting member, a distance from the first friction material to the pivoting shaft being smaller than a distance from the second friction material to the pivoting shaft.

Still further according to the present invention, there is provided an anti-rolling apparatus wherein the brake hinge is displaced in a direction to the friction releasing position by means of a releasing spring.

Still further, according to the present invention, there is provided an anti-rolling apparatus wherein a screw thread is rotatably supported by the supporting member and a nut fixed to the slide supporting member is mounted on the screw thread so that, when a handle is turned, the nut is moved with respect to the screw thread, thereby the slide supporting member being moved.

According to the present invention, there is provided an anti-rolling apparatus comprising a movable weight capable of reciprocating along a predetermined rail, a restoring force generating device for generating a restoring force for the movable weight, and a magnetic damper for generating a damping force for the movable weight, wherein damping coefficient of damping force generated by the magnetic damper is changed along the rail.

According to one aspect of the present invention, there is provided an anti-rolling apparatus wherein the magnetic damper includes an electric conductor member extended along the rail and permanent magnets mounted on the movable weight. Further, the anti-rolling apparatus is so constructed that a cross section of magnetic flux passing the electric conductor member of magnetic flux generated by the permanent magnets is changed along the rail.

According to another aspect of the present invention, there is provided an anti-rolling apparatus wherein the electric conductor member is made of a belt-like member and a width of the belt-like member is changed along the rail. Further the anti-rolling apparatus is constructed that the electric conductor member is made of a belt-like member and the belt-like member contains a plurality of holes so that a cross section of magnetic flux passing the electric conductor member is changed by the holes.

According to still another aspect of the invention, there is provided an anti-rolling apparatus wherein the magnetic damper contains a fixed permanent magnet fixed on the movable weight and a movable permanent magnet which can be moved relative to the movable weight, so that magnetic field or magnetic flux generated by the two permanent magnets can be changed by changing a relative position of the movable permanent magnet.

DESCRIPTION OF THE PREFERRED EMBODIMENTS

Figure 5A:
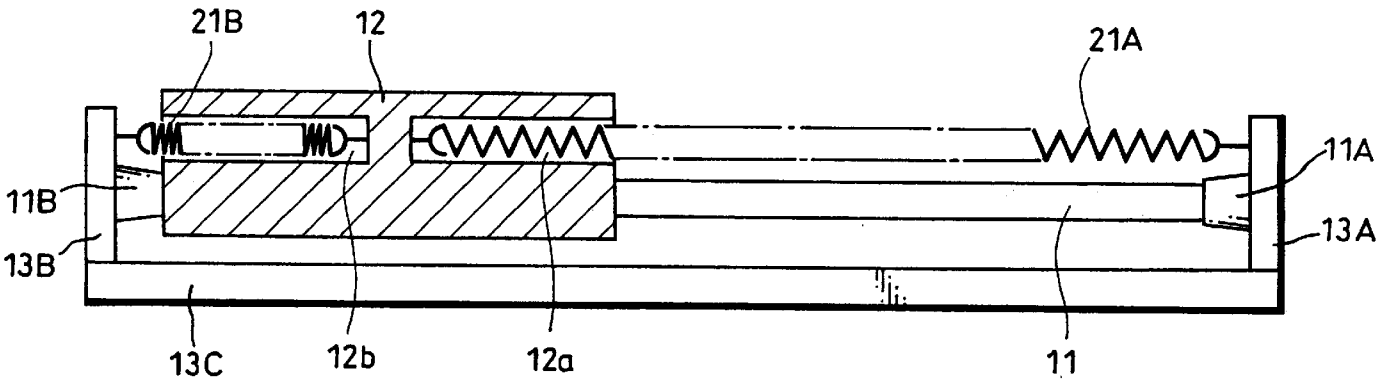
FIGS. 5A and 5B diagrams showing a first example of an anti-rolling apparatus according to the present invention.
Figure 5B:
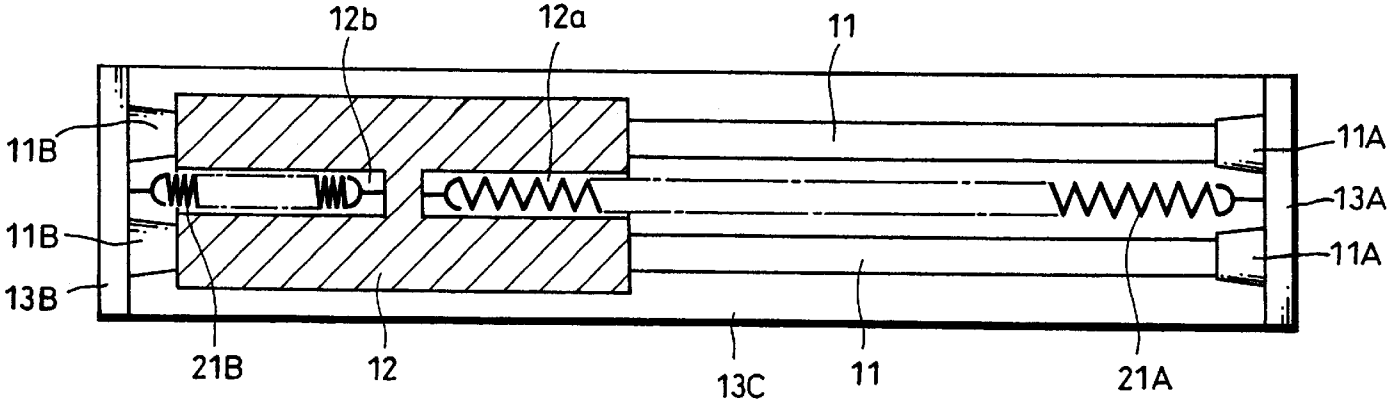
Figure 6A:
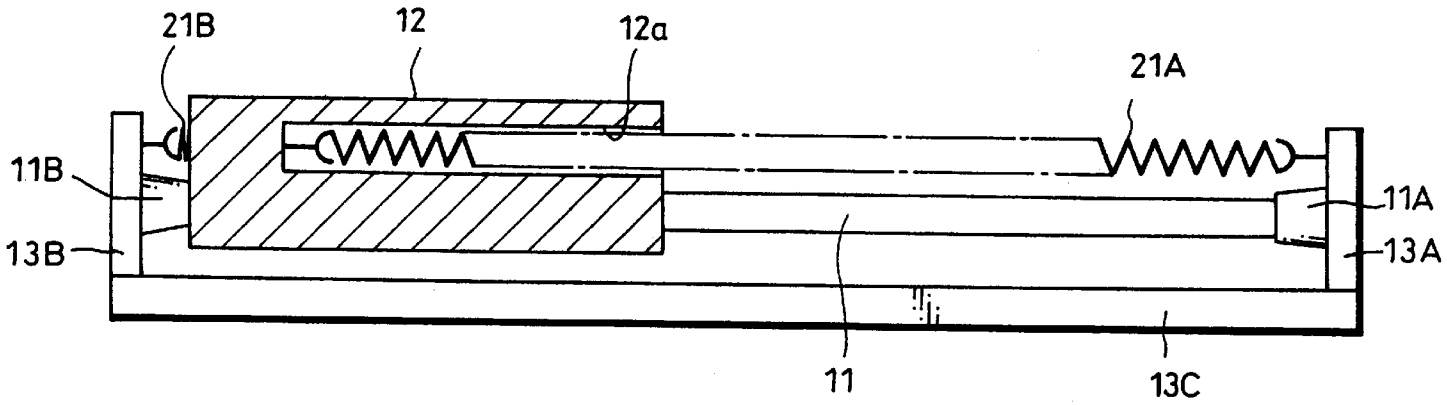
FIGS. 6A and 6B diagrams showing a second example of an anti-rolling apparatus according to the present invention.
Figure 6B:
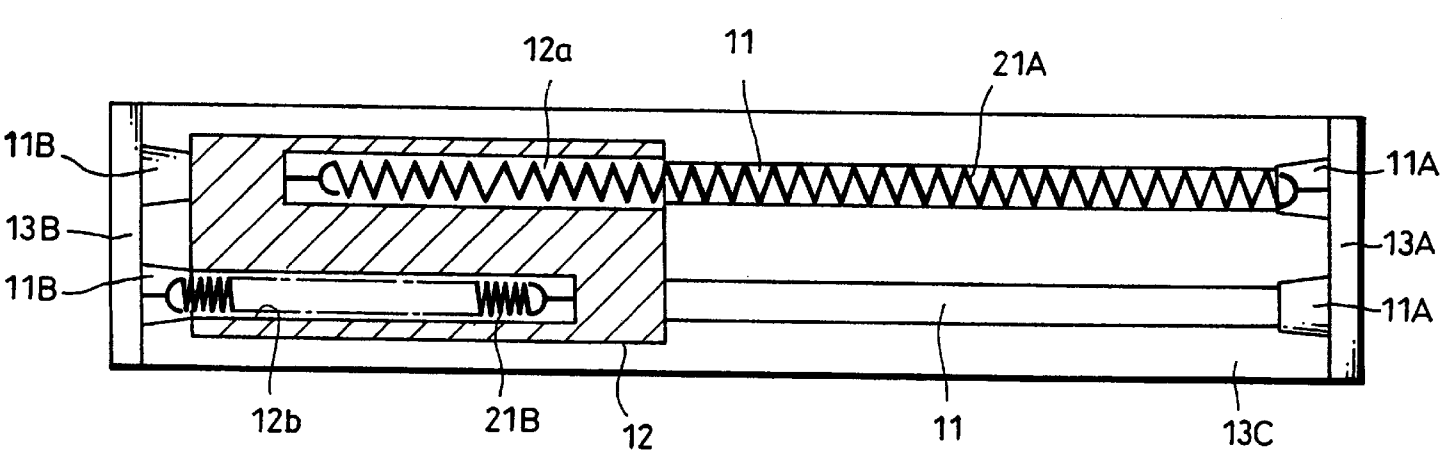

An embodiment of an anti-rolling apparatus according to the present invention will be described with reference to FIGS. 5A, 5B and 6A, 6B. FIGS. 5A, 5B show a first example of the anti-rolling apparatus of the present invention and FIGS. 6A, 6B show a second example thereof. FIGS. 5A, 6A show front views and FIGS. 5B, 6B show plan views of the respective cases.

The anti-rolling apparatus of this embodiment comprises rail members 11, 11, a movable weight 12 which can move freely along the rail members 11, 11, supporting members 13A, 13B for supporting the rail members 11, 11 on both sides, and springs 21A, 21B mounted on both sides of the movable weight 12. The supporting members 13A, 13B are mounted on a base 13C.

The rail members 11, 11 are made of straight members and therefore a traveling path of the movable weight 12 is straight. On both ends of the rail members 11, 11 are mounted, for example, buffering rubbers 11A, 11B.

Figure 6B:
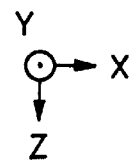

In a second example of the anti-rolling apparatus according to the present invention shown in FIG. 6, the mounting positions of two springs 21A, 21B are different from the first example shown in FIG. 5 and the other configuration may be the same. In the first example, the two springs 21A, 21B are disposed on the same line, while in the second example, the two springs 21A, 21B are disposed on two parallel lines.

Inside ends of the springs 21A, 21B are connected to the movable weight 12 and outside ends thereof are connected to the supporting members 13A, 13B respectively. Although the inside ends of the springs 21A, 21B may be connected to both end faces of the movable weight 12, they may be connected to holes 12*a*, 12*b* provided in the movable weight 12 shown in the Figure.

The movable weight 12 moves freely along the rail members 11, 11, so that the ends of the movable weight 12 make contact with the elastic members 11A, 11B on both ends of the rail members 11, 11. The holes 12*a*, 12*b* in the movable weight 12 need to be deep enough for incorporating the contracted springs.

Figure 1:
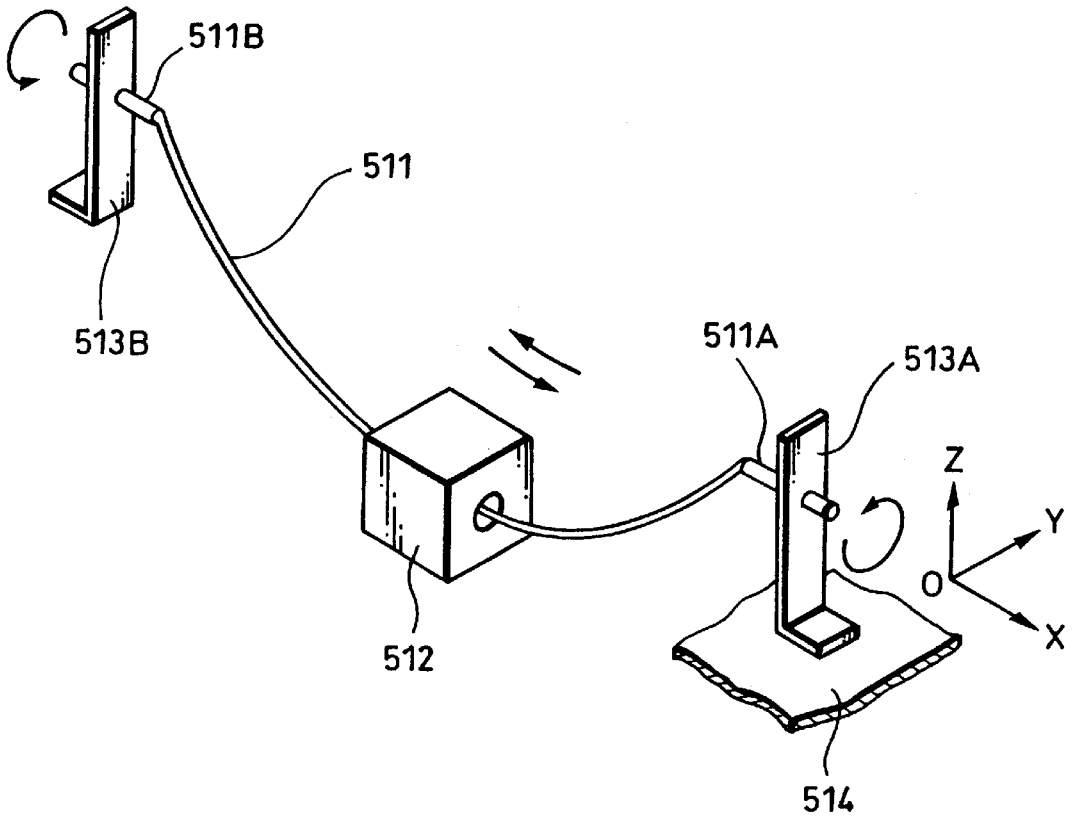
FIG. 1 is a diagram showing a first example of a conventional anti-rolling apparatus.

In the anti-rolling apparatus according to the present invention, a restoring or stability force for the reciprocating motion of the movable weight 12 is generated by the two springs 21A, 21B. When the movable weight 12 moves along the rail members 11, 11, one of the two springs 21A, 21B is contracted while the other one is elongated. For example, in FIGS. 1, 2, the movable weight 12 is disposed at the left ends of the rail members 11, 11, such that the first spring 21A located on the right side is elongated while the second spring located on the left side is contracted. Thus, the restoring or stability force is always generated by the two springs 21A, 21B.

Figure 7A:
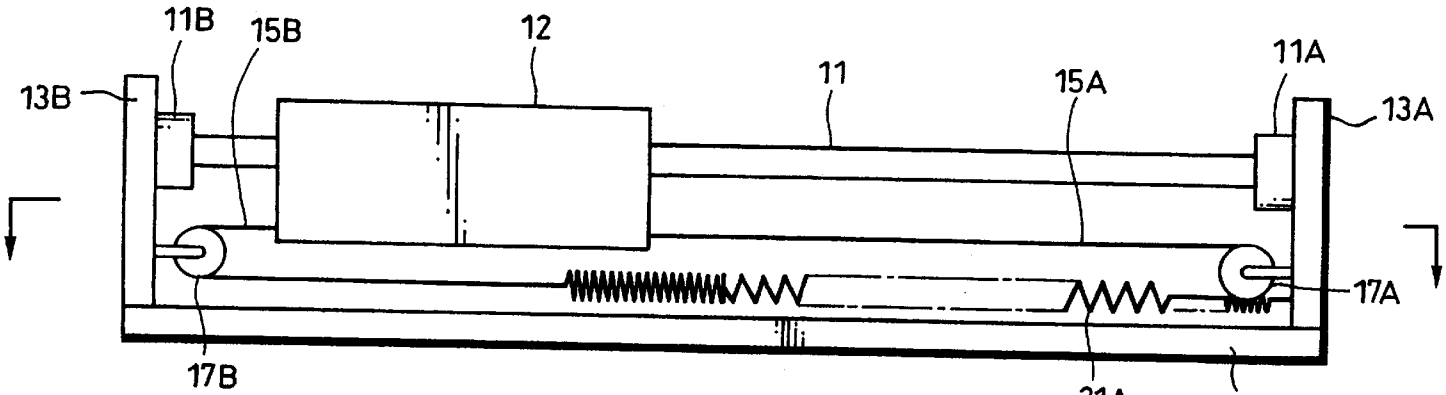
FIGS. 7A and 7B diagrams showing a third example of an anti-rolling apparatus according to the present invention.
Figure 7B:
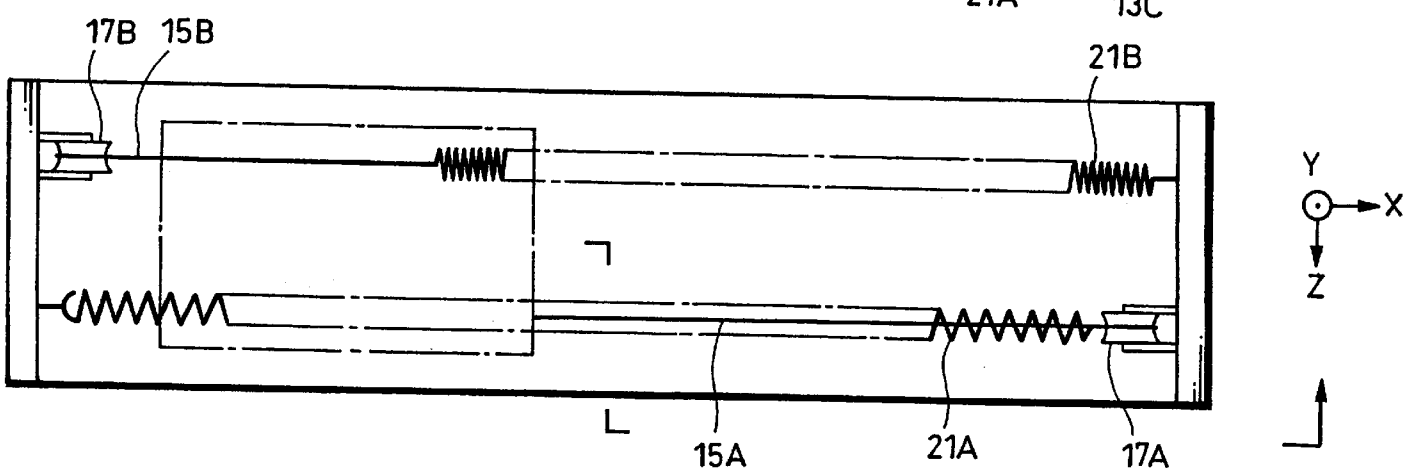

FIGS. 7A, 7B show a third example of the anti-rolling apparatus according to the present invention. FIG. 7A shows a front view thereof and FIG. 7B shows a plan view thereof. According to this example, as shown in FIG. 7A, wires 15A, 15B are attached to both ends of the movable weight 12 and two springs 21A, 21B are attached to the other ends of the wires. The other ends of the two springs 21A, 21B are attached to the supporting members 13A, 13B. The supporting members 13A, 13B have rollers 17A, 17B for guiding the wires 15A, 15B and the wires 15A, 15B are wound around external circumferences of the rollers 17A, 17B.

In the anti-rolling apparatus of this example, as compared to the first and second examples shown in FIGS. 5 and 6 the mounting method for the two springs 21A, 21B is different, while the other configuration may be the same.

Next, the vibration system of the anti-rolling apparatus of the present invention will be analyzed. X-axis is set along the rail members 11, 11 and y-axis is set upwardly in perpendicular direction to the x-axis. Further, z-axis is set perpendicular to the x- and y-axes (perpendicular to this paper sheet). Assume that when the movable weight 12 is stationary, the two springs 21A, 21B are neither elongated nor contracted. An origin O of coordinate is set in the gravity center G of the movable weight 12. Assuming that the length and elastic modulus of the two springs 21A, 21B are the same, the origin 0 exists in the center of the rail members 11, 11.

The anti-rolling apparatus of this example is so constructed as to reduce a rolling around a z-axis. Thus the anti-rolling apparatus of this example is disposed such that the rail members 11, 11 are disposed on a plane perpendicular to the z-axis.

In the first and second examples, the restoring force of the movable weight 12 is proportional to the displacement of the two springs 21A, 21B and the natural oscillation cycles T thereof are expressed as follows.

$$T = 2\pi\sqrt{(m / K_{EQ})} \tag{2}$$

$$K_{EQ} = K_1 + K_2$$

where m is mass of the movable weight 12, $K_1$, $K_2$ are spring constants of the two springs 21A, 21B and $K_{EQ}$ is equivalent spring constant.

When the natural oscillation cycle T of the anti-rolling apparatus is adjusted, the two springs 21A, 21B are replaced with springs having different spring constants $K_1'$, $K_2'$.

Figure 8:
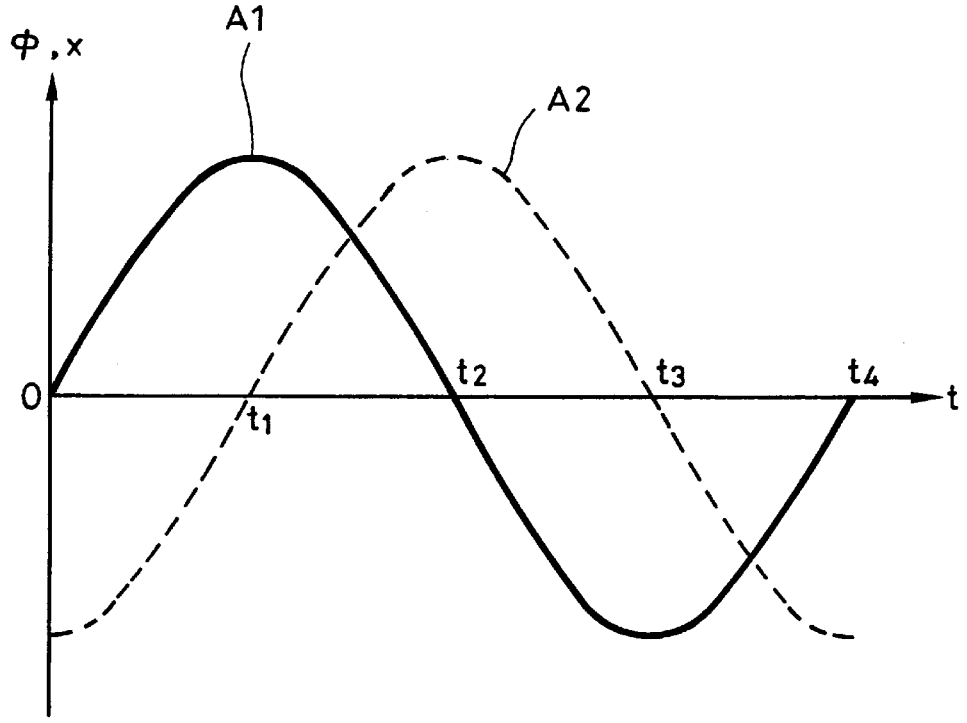
FIG. 8 is a diagram showing a relationship between an object whose rolling is to be suppressed and a movable weight.

The function of the anti-rolling apparatus of this example will be described with reference to FIG. 8. The solid line A1 indicates an oscillation of an object whose rolling is to be suppressed, for example, a marine structure and the broken line A2 indicates a reciprocating motion of the movable weight 12. The anti-rolling apparatus of this example is a vibration system comprising the movable weight 12 and two springs 21A, 21B. When the natural oscillation cycle T of this vibration system coincides with the natural oscillation cycle of the object, an optimum anti-rolling effect can be obtained. If the object is vibrated, the movable weight 12 is also vibrated. The vibration of the object is a rotary motion around a vibration center and the movable weight 12 is reciprocated linearly. The reciprocating motion of the movable weight 12 is delayed by ¼ cycle relative to the vibration of the object.

Figure 9:
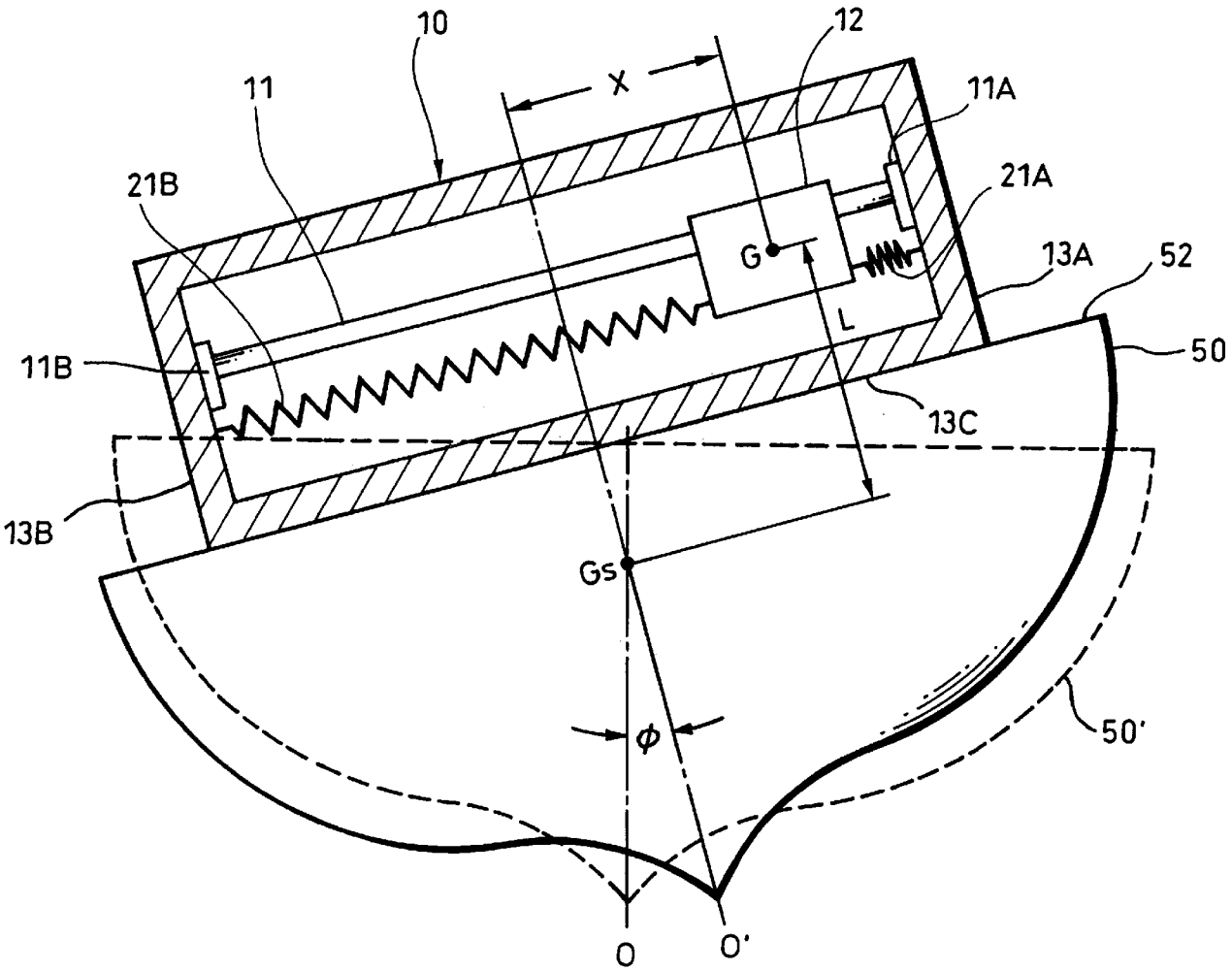
FIG. 9 is a diagram showing an example of the anti-rolling apparatus according to the present invention which is being mounted on a ship.

Refer to FIG. 9. FIG. 9 shows a state in which the anti-rolling apparatus 10 according to the present invention is loaded on an actual ship 50. The broken line 50' in FIG. 9 shows a cross section of a ship in stationary condition and the solid line 50 indicates a cross section of the ship inclined by an angle of inclination ϕ. Both indications are cross sections of a ship cut out along a plane perpendicular to the stem-stern line of the ship. Assume that the gravity center of a ship in the stoppage condition is $G_S$ and a perpendicular line passing the gravity center $G_S$ is $OG_S$. Further, assume that a perpendicular line passing the gravity center $G_S$ of the ship 50 inclined at the angle of inclination ϕ is $O'G_S$.

The anti-rolling apparatus 10 is disposed so as to reduce a rolling motion of the ship 50 or an oscillation around the rotary axis parallel to the stem-stern line of the ship. Thus, the anti-rolling apparatus 10 is disposed such that the rail members 11, 11 are extended in the direction of the width of the ship 50. Further, the anti-rolling apparatus 10 is disposed upward of the gravity center $G_S$ of the ship 50.

Assuming that the ship 50 loaded with the anti-rolling apparatus 10 is a vibration system having two degrees of freedom, an equation of motion is introduced so as to obtain its frequency characteristics.. The equations of motion for the ship 50 and anti-rolling apparatus 10 are expressed as follows. Here it is assumed that the rolling angle ϕ of the ship is minute.

$$(I_S+mL^2)d^2\phi/dt^2+mL\cdot d^2x/dt^2=mgL\phi+mgx-K-C_S d\phi/dt+Pm\cdot d^2x/dt^2+ mL\cdot d^2\phi/dt^2=mg\phi-K_{EQ}x-C_G\cdot dx/dt \tag{3}$$

where:

ϕ: rolling angle of the ship $I_S$: moment of inertia of the ship $C_S$: damping coefficient against the rolling of the ship $K_S$: restoring torque Constance of the ship P: compulsory force x: displacement of the movable weight 12 m: mass of the movable weight 12

L: the distance between the gravity center $G_S$ of the ship and the gravity center of the movable weight 12

$C_G$: damping coefficient of the anti-rolling apparatus 10

$K_{EQ}$: equivalent spring constant of the anti-rolling apparatus

Assuming that dϕ/dt=ϕ=0 and dx/dt=x=0 where t=0, as an initial condition, these two expressions are Laplace-transformed and then the result is expressed in terms of frequency domain as follows.

$$-[(I_S+mL^2)\omega^2+mgL-K_S-jC_S\omega]\phi-(mL\omega^2+mg)\,x=P(mL\omega^2+mg)\phi+ (m\omega^2-K_{IQ}-jC_G\omega)x=0 \tag{4}$$

where j is imaginary unit. Then the following expressions are set.

$$A=-m\omega^2+K_{EQ}$$

$$B=C_G\omega$$

$$C=[(I_S+mL^2)\omega^2+mgL-K_S](m\omega^2-K_{EQ})-(mL\omega^2+mg)^2-C_SC_G\omega^2$$

$$D=[(I_S+mL^2)\omega^2+mgL-K_S]C_G\omega-(m\omega^2-K_{EQ})C_S\omega$$

$$E=-(mL\omega^2+mg) \quad (5)$$

Then the variables $\phi$, x are expressed as follows.

$$\phi=[(A+jB)/(C+jD)]P$$

$$x=[E/(c+jD)]P \quad (6)$$

The gain characteristics of the variables $\phi$, x are expressed as follows.

$$|\phi| = \sqrt{[(A^2 + B^2)/(C^2 + D^2)]P} \quad (7)$$

$$|x| = \sqrt{[E^2/(C^2 + D^2)]P}$$

The phase characteristics of the variables $\phi$, x are expressed as follows.

$$\angle\phi(j\omega)=\tan^{-1}[(BC-AD)/(AC+BD)]$$

$$\angle x(j\omega)=\tan^{-1}(-D/C) \quad (8)$$

Figure 10A:
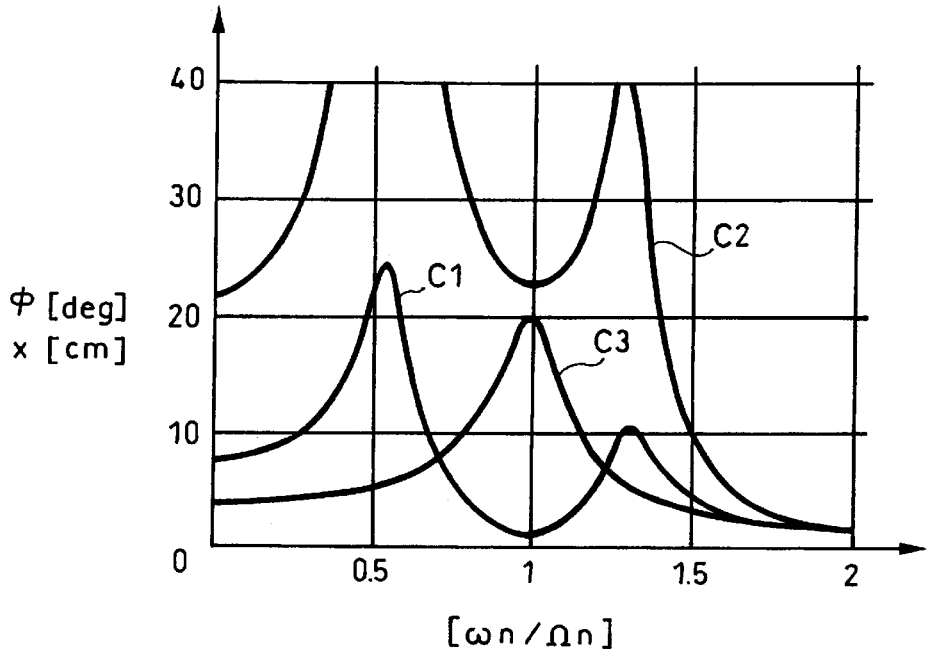
FIGS. 10A and 10B are graphs showing a vibration characteristic and a phase characteristic of a vibration system having two degrees of freedom including an anti-rolling apparatus and a ship.
Figure 10B:
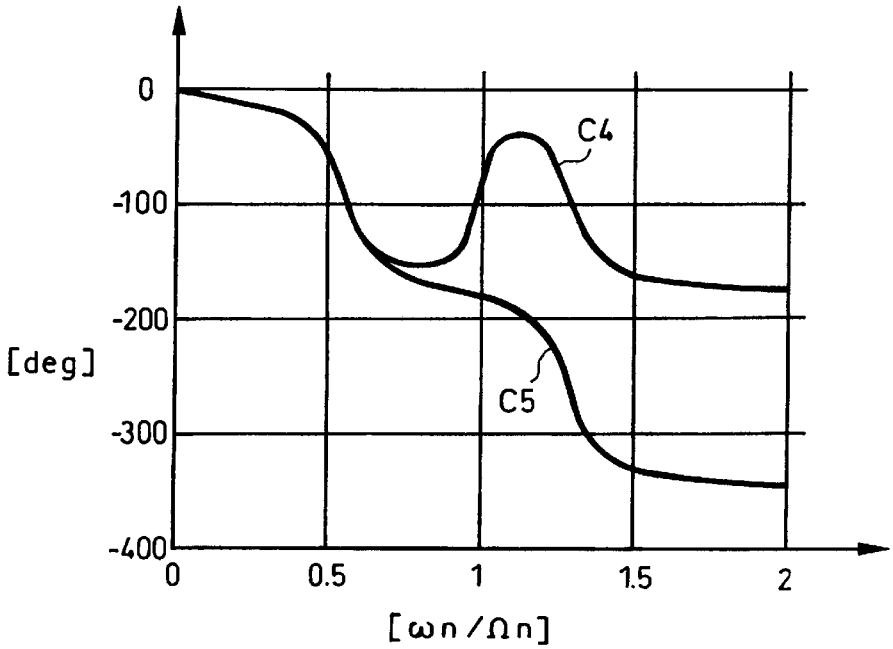

FIGS. 10A dan 10B will be explained. FIG. 10A shows gain characteristics of the vibration system having two degrees of freedom shown in FIG. 9. FIG. 10B shows the phase characteristics. Its abscissa axis indicates a ratio $\omega_n/\Omega_n$ of the natural frequency $\omega_n$ of the movable weight 12 of the anti-rolling apparatus 10 with respect to the natural frequency $\Omega_n$ of the ship 50.

FIG. 10A will be explained. A curve Cl indicates a rolling angle $\phi$ (deg) of a ship 50 equipped with the anti-rolling apparatus of this example. A curve C2 indicates a maximum displacement (or maximum amplitude)×(cm) of the movable weight 12. A curve C3 indicates a rolling angle $\phi$ (deg) of a ship 50 not equipped with the anti-rolling apparatus 10.

When the natural frequency $\omega_n$ of the movable weight 12 of the anti-rolling apparatus 10 is substantially equal to the natural frequency $\Omega_n$ of the ship 50 or the ratio $\omega_n/\Omega_n\approx1$, the curves C1 and C3 are compared. As evident from this comparison, the rolling angle $\phi$ of the ship 50 equipped with the anti-rolling apparatus 10 is considerably smaller than the rolling angle of the ship 50 not equipped with the anti-rolling apparatus 10. Therefore, by substantially equalizing the natural frequency $\omega_n$ of the movable weight 12 of the anti-rolling apparatus 10 with the natural frequency $\Omega_n$ of the ship 50, an effect of the anti-rolling apparatus 10 can be fully exerted.

At this time, as shown by the curve C2, the maximum displacement (or maximum amplitude)×(cm) of the movable weight 12 becomes a minimum value.

FIG. 10B will be explained. The curve C4 indicates a difference of phase $\Delta\phi$ (deg) of the rolling angle of the ship 50 equipped with the anti-rolling apparatus of this example relative to rolling by external force acting on the ship 50. The curve C5 indicates a difference of phase $\Delta$×(cm) of motion of the movable weight 12 relative to rolling by external force acting upon the ship 50.

When the natural frequency $\omega_n$ of the movable weight 12 of the anti-rolling apparatus 10 is substantially equal to the natural frequency $\Omega_n$ of the ship 50 or the ratio $\omega_n/\Omega_n\approx1$, the curves C4 and C5 are compared. As evident from this comparison, the rolling angle $\phi$ of the ship 50 equipped with the anti-rolling apparatus 10 is delayed by about 90° in terms of phase with respect to rolling by external force. The phase angle of motion of the movable weight 12 of the anti-rolling apparatus 10 is delayed by about 90° with respect to the rolling angle $\phi$ of the ship 50. As a result, the phase angle of the motion of the movable weight 12 in the anti-rolling apparatus 10 is delayed by about 180° with respect to the rolling by external force.

The present invention has such an advantage that because the rail members are straight, it is possible to reduce production cost of the apparatus.

The present invention has such an advantage that because the rail members are straight, it is possible to reduce a volume occupied by the apparatus.

According to the present invention, even if the natural oscillation cycle of the movable weight can be changed by such a simple work as replacing with a spring having a different spring constant. Thus, it is possible to achieve an optimum anti-rolling effect for the object.

Figure 11A:
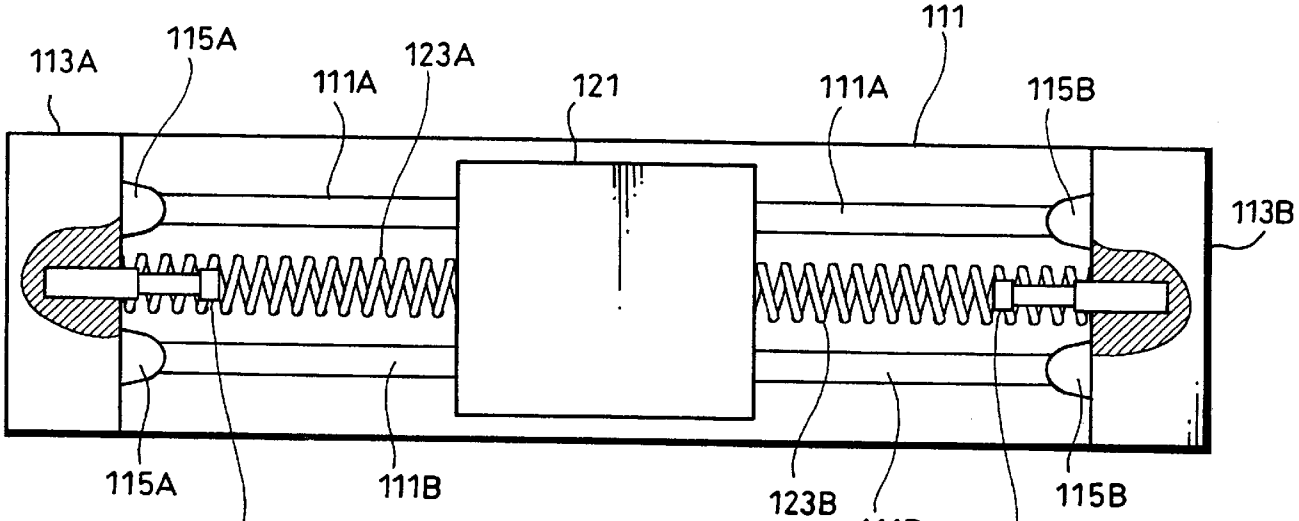
FIGS. 11A and 11B are diagrams showing an arrangement of the anti-rolling apparatus according to the present invention.
Figure 11B:
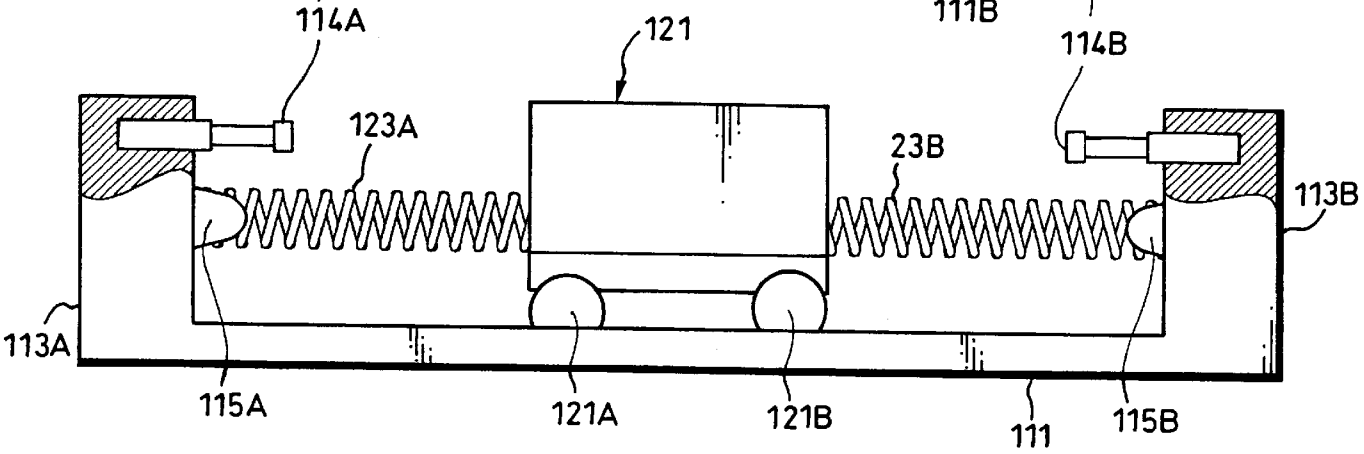

An example of an anti-rolling apparatus using the principle of a dynamic vibration reducer in the present invention will next be described with reference to FIGS. 11A and 11B. This swing reducing device has an rail member 111 as a bottom member, a movable weight 121 freely movable along the rail member 111, and a pair of supporting members 113A, 113B for supporting the rail member 111 on both sides thereof. Two pairs of wheels 121A, 121B are mounted to the movable weight 121.

Two parallel orbit grooves 111A, 111B constituting an orbit are formed on an upper face of the rail member 111. Two pairs of wheels 121A, 121B are mounted to the movable weight 121. The wheels 121A, 121B are respectively engaged with the orbit grooves 111A, 111B.

Springs 123A, 123B are mounted to right and left sides of the movable weight 121. The other ends of the springs 123A, 123B are respectively mounted to the supporting members 113A, 113B. Restoring force of the movable weight 121 is generated by elastic force of each of the springs 123A, 123B. When an anti-rolling object is swung and the movable weight 121 is moved along the rail member 111, the springs 123A, 123B are biased. The movable weight 121 is reciprocated, i.e., vibrated along the rail member 111 by the restoring force of each of the springs 123A, 123B.

Shock absorbers 114A, 114B and buffer rubbers 115A, 115B are respectively mounted to the supporting members 113A, 113B on both sides of the anti-rolling apparatus. The anti-rolling apparatus is constructed such that a shock of the movable weight 121 is absorbed by the shock absorbers 114A, 114B and the buffer rubbers 115A, 115B.

It is generally necessary to generate an optimum anti-rolling action to the anti-rolling object in the anti-rolling apparatus that a vibrating period of the movable weight 121 is equal to a swinging period of the anti-rolling object and a predetermined phase difference exists between both the vibration and the swing.

For example, when a swinging angle of the anti-rolling object is large and the movable weight 121 hits against the shock absorbers 114A, 114B at both ends of the anti-rolling apparatus, a phase relation of both the movable weight and the shock absorbers is deteriorated so that no desirable anti-rolling action is obtained. Accordingly, a reciprocating (vibrating) amplitude of the movable weight 121 is normally set or designed such that no movable weight 121 hits against the shock absorbers 114A, 114B.

Figure 12A:
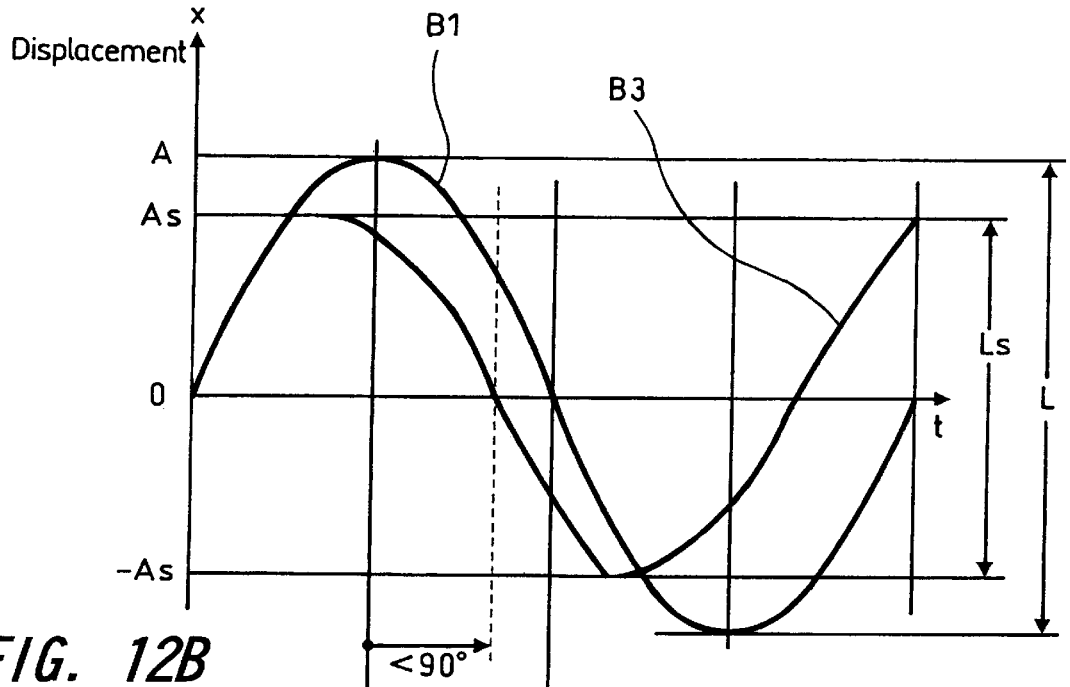
FIGS. 12A and 12B are diagrams used to explain a phase relationship between a movable mass of the anti-rolling apparatus according to the present invention and an object whose rolling is to be suppressed.

The phase relation between the movable weight 121 and the anti-rolling object will next be explained with reference to FIGS. 12A and 12B. A curve B1 of FIG. 12A shows a vibration of the movable weight 121 when it is assumed that the rail member 111 is infinitely long. The movable weight 121 can freely move without hitting this movable weight against the shock absorbers 114A, 114B even when the vibrating amplitude is large. Accordingly, the reciprocating movement of the movable weight 121 is represented by a sine wave curve.

Figure 12B:
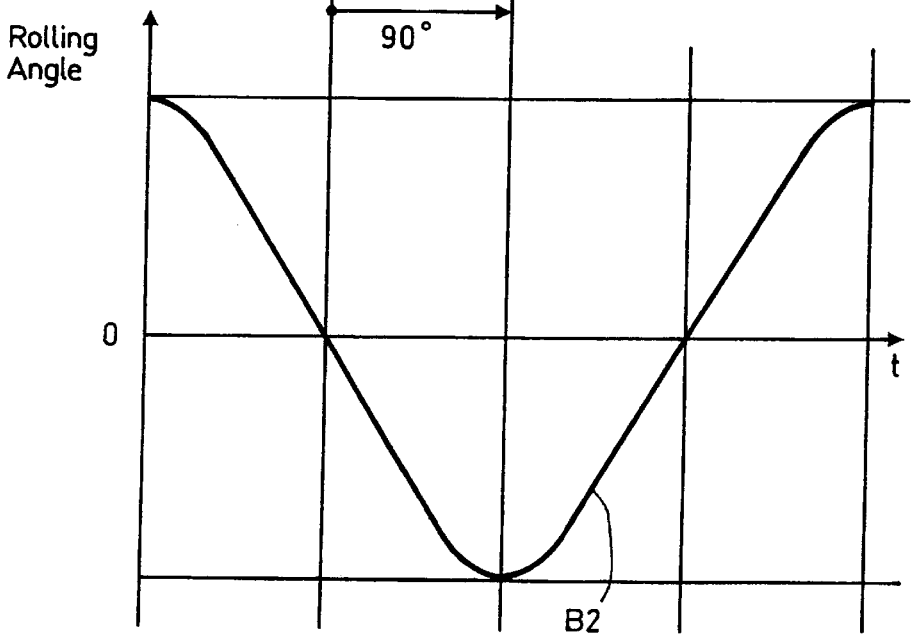

A curve B2 of FIG. 12B shows a vibration of the anti-rolling object. As can be seen from comparison of the curves B1 and B2, the vibrating period of the movable weight 121 and the swinging period of the anti-rolling object are in conformity with each other and a phase of the movable weight 121 is delayed 90° in comparison with the phase of the anti-rolling object.

However, in reality, the length of the rail member 111 is finite so that the movable weight 121 hits against the shock absorbers 114A, 114B and the reciprocating movement of the movable weight 121 is limited. An actually movable path length $L_S=2A_S$ of the movable weight 121 is shorter than an original path length L=2A of the movable weight 121.

Namely, the following relation is formed.

$$L_S<L \tag{9}$$

In this case, the movable weight 121 is moved along a curve having a modified shape of a sine wave as shown by a curve B3 of FIG. 12A. As shown in FIGS. 12A and 12B, this curve B3 shows a vibration having a phase difference smaller than 90° with respect to the phase of the anti-rolling object.

Thus, when the movable weight 121 hits against the shock absorbers 114A, 114B, a desirable phase relation between the movable weight 121 and the anti-rolling object, the phase difference 90° in this example is changed so that the anti-rolling action with respect to the anti-rolling object is reduced.

In the above example, the shock absorbers 114A, 114B and the buffer rubbers 115A, 115B for absorbing the shock of the movable weight 121 are arranged, but similar effects are also obtained even when the shock absorbers 114A, 114B and the buffer rubbers 115A, 115B are not arranged. Further, a damper for providing damping force to the movement of the movable weight 121 may be arranged.

Figure 13A:
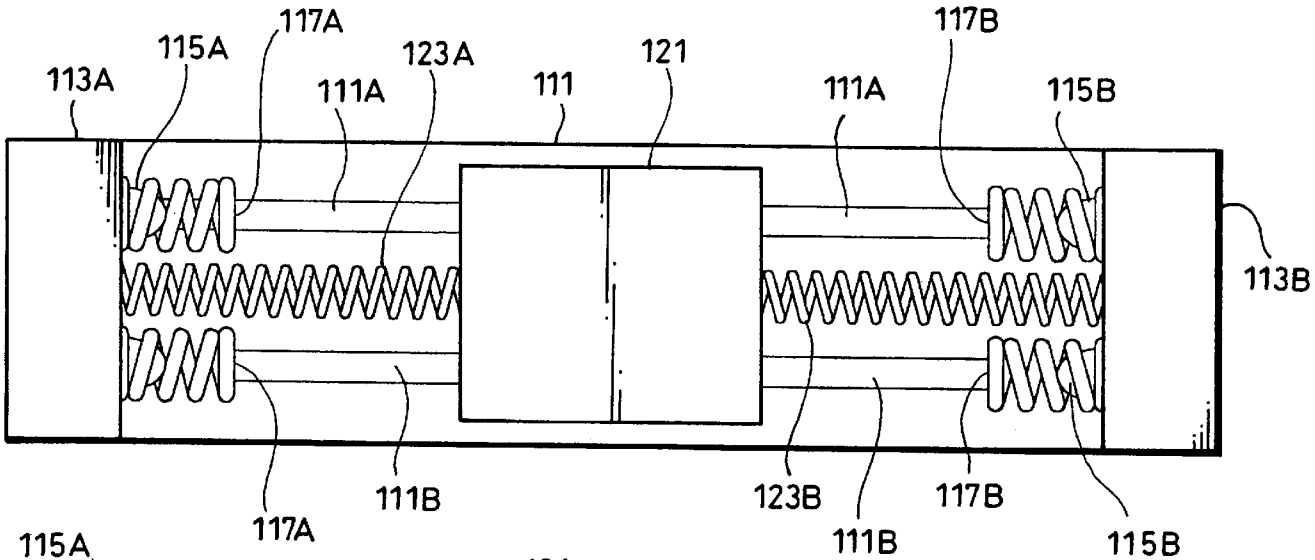
FIGS. 13A and 13B are diagrams showing an arrangement of the anti-rolling apparatus according to the present invention.
Figure 13B:
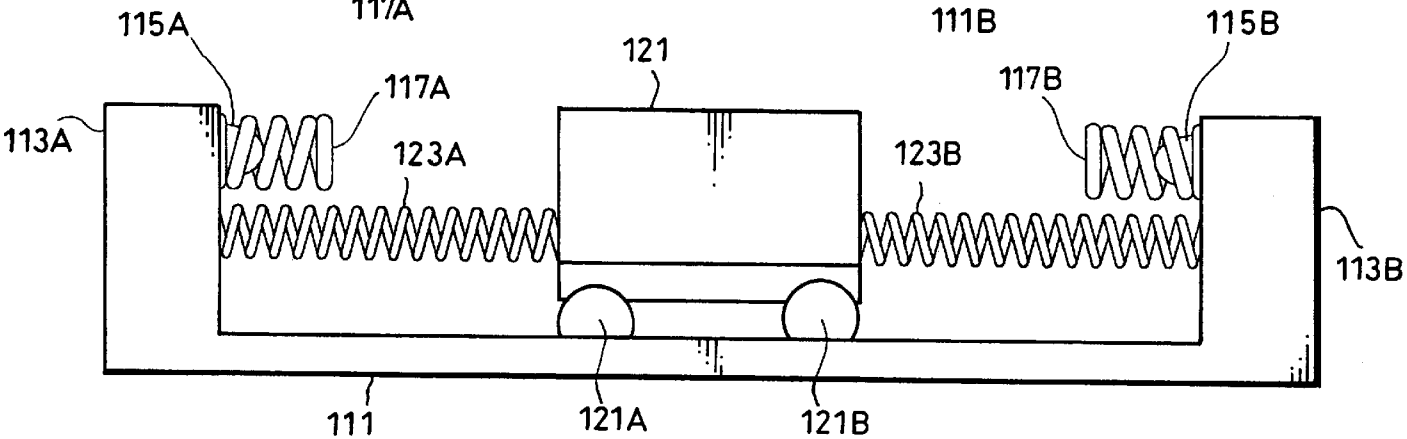

An example of an anti-rolling apparatus using the principle of a dynamic vibration reducer in the present invention will next be described with reference to FIG. 13.

Buffer rubbers 115A, 115B and springs 117A, 117B for stoppers are respectively mounted to the supporting members 113A, 113B on both sides of the anti-rolling apparatus. The anti-rolling apparatus in this example differs from the anti-rolling apparatus shown in FIGS. 11A and 11B in that the springs 117A, 117B for stoppers are arranged instead of the shock absorbers 114A, 114B. The other constructions of the anti-rolling apparatus may be similar to those of the anti-rolling apparatus shown in FIGS. 11A and 11B.

Functions of the springs 117A, 117B for stoppers arranged in the anti-rolling apparatus in the present invention will be explained with reference to FIGS. 14A and 14B. These springs 117A, 117B for stoppers function such that a desirable phase relation between the movable weight 121 and the anti-rolling object is maintained even when a swinging angle of the anti-rolling object is large and an original amplitude A of a vibration of the movable weight 121 is larger than an actually movable path length $L_S$ of the movable weight 121 and the vibration of the movable weight 121 is limited.

Figure 14A:
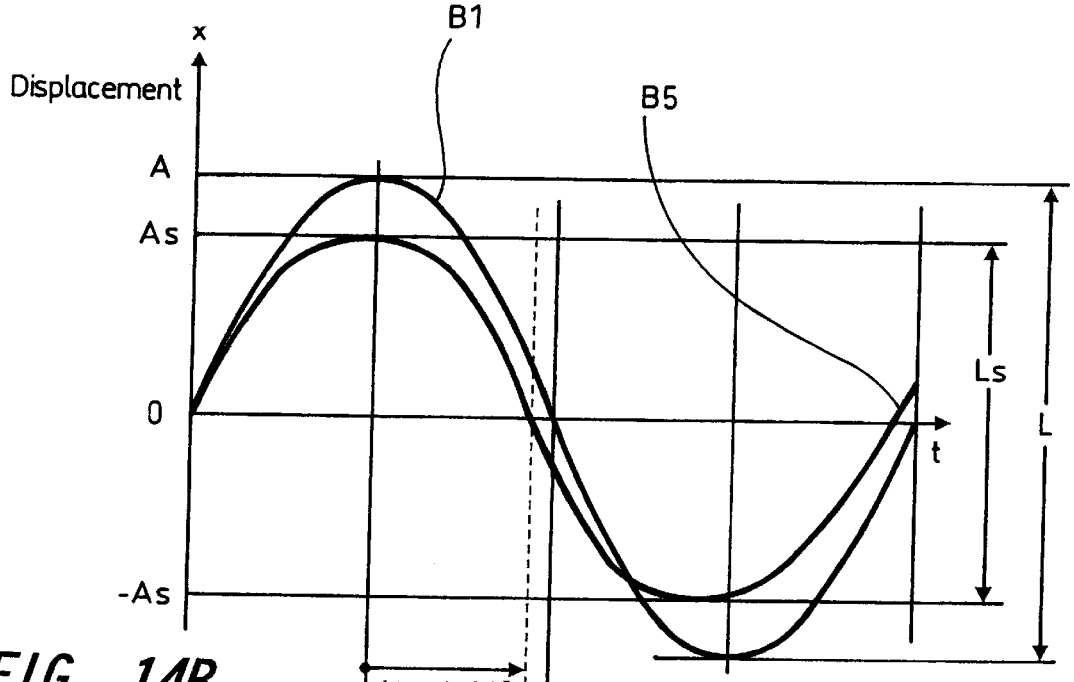
FIGS. 14A and 14B are diagrams used to explain a phase relationship between a movable mass of the anti-rolling apparatus according to the present invention and an object whose rolling is to be suppressed.
Figure 14B:
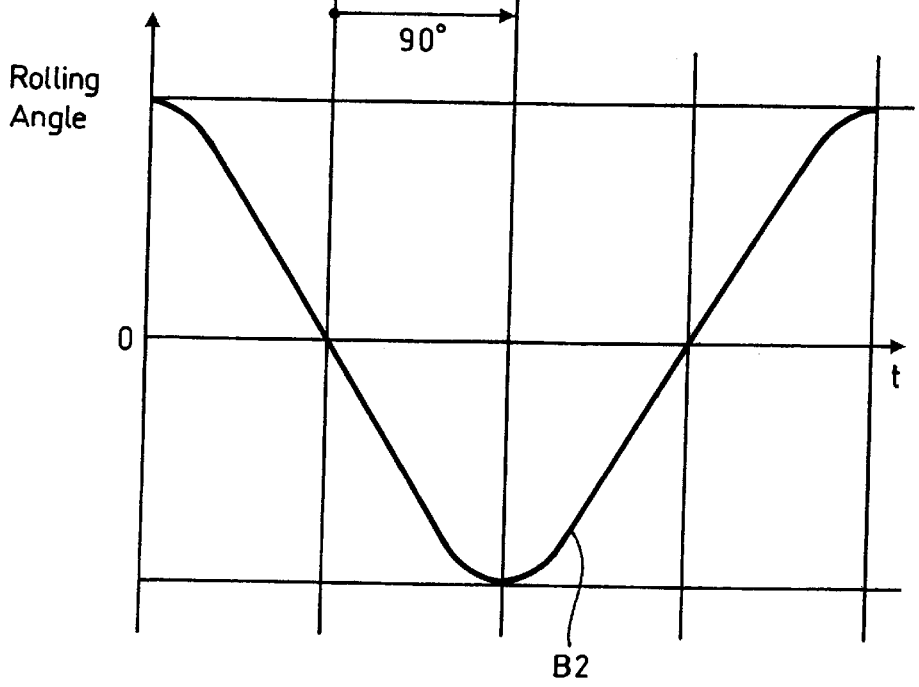

FIGS. 14A and 14B are graphs showing the phase relation between the movable weight 121 and the anti-rolling object similar to FIGS. 12A and 12B. A curve B1 of FIG. 14A is the same as the curve B1 of FIG. 12A and shows a vibration of the movable weight 121 when it is assumed that the rail member 111 is infinitely long. A curve B2 of FIG. 14B is the same as the curve B2 of FIG. 12B and shows a vibration of the anti-rolling object. A vibrating period of the movable weight 121 is equal to a swinging period of the anti-rolling object. A phase of the movable weight 121 is delayed 90° in comparison with the phase of the anti-rolling object.

A curve B5 of FIG. 14A shows a vibration of the movable weight 121 when the rail member 111 is a finite length and the movable weight 121 hits against the springs 117A, 117B for stoppers. When the swinging angle of the anti-rolling object is large and the movable weight 121 hits against the springs 117A, 117B for stoppers on both sides thereof, the movable weight 121 is moved along a curve having a modified shape of a sine wave, but a change in phase, i.e., a phase delay is extremely small in comparison with the curve B1 or B3 (FIG. 12). Namely, a phase difference of 90° with respect to the phase of the anti-rolling object is approximately maintained in the vibration of the movable weight 121.

When the movable weight 121 comes in contact with the springs 117A, 117B for stoppers and these springs 117A, 117B for stoppers are shrunk, kinetic energy of the movable weight 121 is converted to elastic energies of the springs 117A, 117B for stoppers and is accumulated. When shrinking amounts of the springs 117A, 117B for stoppers become maximum, a moving direction of the movable weight 121 is inverted and the springs 117A, 117B for stoppers begin to be extended. The elastic energies accumulated in the springs 117A, 117B for stoppers are converted to the kinetic energy of the movable weight 121.

The moving direction of the movable weight 121 is inverted when the shrinking and extending amounts of the springs 117A, 117B for stoppers become maximum. An inverting time of this moving direction is delayed in comparison with a case in which the movable weight 121 hits against the shock absorbers 114A, 114B. Accordingly, the phase relation with respect to the anti-rolling object is maintained.

Accordingly, the springs 117A, 117B for stoppers are designed such that these springs absorb the kinetic energy $(1/2)mv^2$ of the movable weight 121. The movement of the movable weight 121 is represented as follows.

$$X=A\sin\omega_n t \tag{10}$$

$$V=dX/dt=A\omega\cos\omega_n t$$

Here, $\omega_n$ is an angular velocity of the vibration of the movable weight 121. The elastic energy E stored in each of the springs 117A, 117B for stoppers is determined as follows by a spring constant k and a deforming amount x of each of the springs.

$$E=(1/2)kx^2=(1/2)mv^2 \tag{11}$$

When the spring constant k is increased, the deforming amount x of each of the springs is reduced and the actually movable path length $L_S$ of the movable weight 121 is preferably increased. However, when rigidity of each of the springs is increased by increasing the spring constant k, a shock is caused when the movable weight 121 comes in contact with the springs 117A, 117B for stoppers.

Accordingly, results similar to those obtained by hitting the movable weight against a rigid body are obtained.

In contrast to this, when the spring constant k is reduced, the deforming amount x of each of the springs is increased and the actually movable path length $L_S$ of the movable weight 121 is unpreferably reduced. However, no shock is caused even when the movable weight 121 hits against the springs 117A, 117B for stoppers. The springs 117A, 117B for stoppers are designed in consideration of these contents.

In the above example, the shock absorbers 114A, 114B and the buffer rubbers 115A, 115B for absorbing the shock of the movable weight 121 are arranged, but similar effects are also obtained even when the shock absorbers 114A, 114B and the buffer rubbers 115A, 115B are not arranged. Further, a damper for providing damping force to the movement of the movable weight 121 may be arranged.

In the present invention, the anti-rolling apparatus is constructed such that the kinetic energy of the movable weight is absorbed and emitted by the springs for stoppers. Accordingly, the anti-rolling apparatus has advantages in that the movable weight and the anti-rolling object can maintain a desirable phase relation.

In the present invention, the movable weight and the anti-rolling object can maintain the desirable phase relation even when a swinging angle of the anti-rolling object is large. Accordingly, the anti-rolling apparatus has advantages in that optimum swing reducing effects to the anti-rolling object can be achieved.

In the present invention, the desirable phase relation between the movable weight and the anti-rolling object can be maintained and the optimum swing reducing effects to the anti-rolling object can be achieved by a relatively simple device even when the swinging angle of the anti-rolling object is large.

Figure 15A:
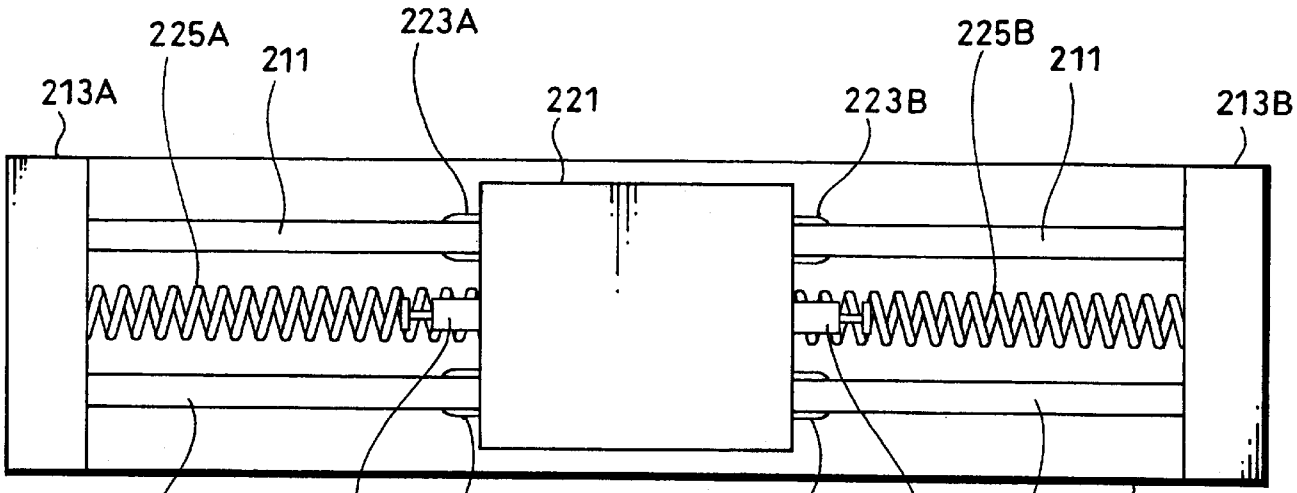
FIGS. 15A and 15B are diagrams showing an arrangement of the anti-rolling apparatus according to the present invention.
Figure 15B:
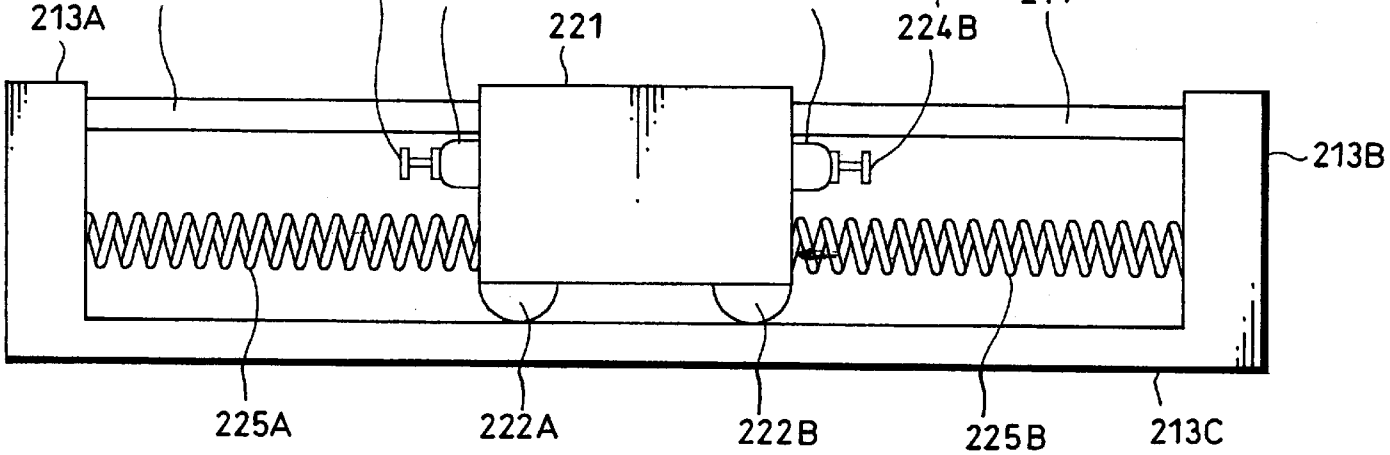

An anti-rolling apparatus using dynamic vibration reducer principle will be described with reference to FIGS. 15A and 15B. This anti-rolling apparatus comprises two rail members 211, 211 and a movable weight 221 capable of moving freely along the rail members 211, 211. The rail members 211, 211 are supported by supporting members 213A, 213B.

Buffer rubbers 223A, 223B and shock absorbers 224A, 224B are mounted before and after the movable weight 221, and wheels 222A, 222B are mounted on the bottom thereof. The wheels 222A, 222B can travel on a bottom member 213C.

The anti-rolling apparatus is provided with a restoring force generating device for generating a restoring force for the movable weight 221. In this example, the restoring force generating device includes springs 225A, 225B mounted before and after the movable weight 221. The other ends of the springs 225A, 225B are connected to the supporting members 213A, 213B located on both sides.

An operation of the anti-rolling apparatus according to the present example will be described. This anti-rolling apparatus is installed so that the rail members 211, 211 are extended along a plane perpendicular to a rolling axis of an object whose rolling is to be reduced. If the object rolls around the rolling axis, the movable weight 221 is moved along the rail members 211, 211. If the movable weight 221 moves, the movable weight 221 is vibrated because of a restoring force by a restoring force generating device or the springs 225A, 225B.

The vibration of the movable weight 221 is designed so as to have the same cycle as a vibration of the object and a predetermined difference in phase. An anti-rolling effect is produced for the object by the vibration of the movable weight 221. For details of the anti-rolling effect by the movable weight 221, see Japanese Patent Application No. H8-68109 filed by the same applicant as this applicant in Mar. 25, 1996.

When the rolling angle of the object is increased, an amplitude of the movable weight 221 is increased so that the buffer rubbers 223A, 223B and the shock absorbers 224A, 224B strike the supporting members 213A, 213B thereby absorbing shock.

A halt/fixing device provided on an anti-rolling apparatus will be described with reference to FIGS. 16A to 16C. The halt/fixing device is provided for halting and fixing the movable weight 221. In this embodiment, the halt/fixing device is provided on a bottom face or a side face of the movable weight 221. For example, a bottom face of the movable weight 221 is formed on the curved surface 221B and a concave portion 221A is provided in the center thereof. On the other hand, the bottom member 513C contains a wheel 227 movable vertically or in up-down direction. For the wheel 227 to always engage with the curved surface 221B, a shaft supporting the wheel 231 is provided with a spring 229.

The curved surface 221B on the bottom of the movable weight 221 and the wheel 231 form a cam structure comprising a cam and cam follower. When the movable weight 221 reciprocates, the wheel 227 is moved vertically or in up-down direction corresponding to a curved line of the curved surface 221B.

An external diameter of the wheel 227 is designed to be slightly smaller than an internal diameter of the concave portion 221A for the wheel 227 to engage with the concave portion 221A.

Figure 16A:
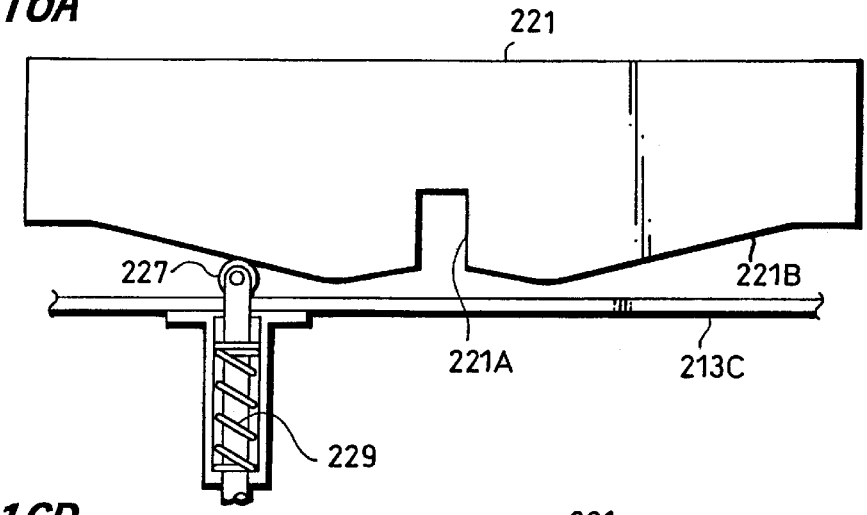
FIGS. 16A to 16C are diagrams showing a first example of a halt/fixing device of the anti-rolling apparatus according to the present invention.
Figure 16B:
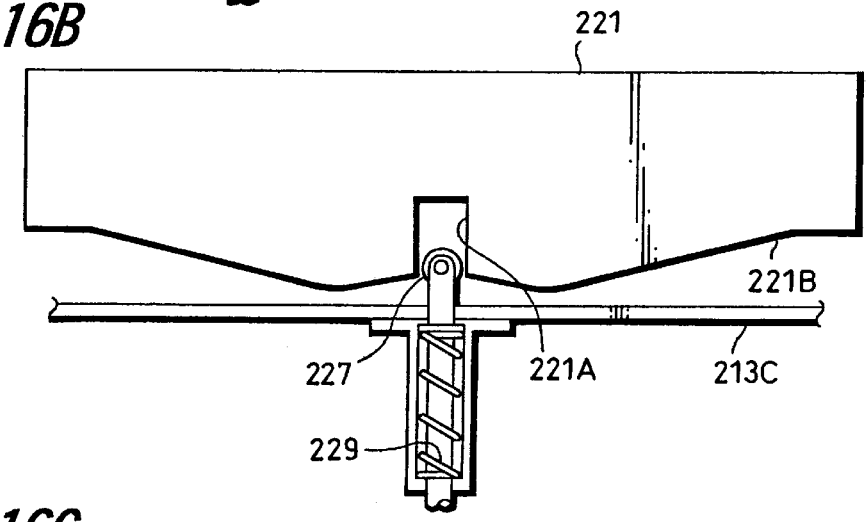
Figure 16C:
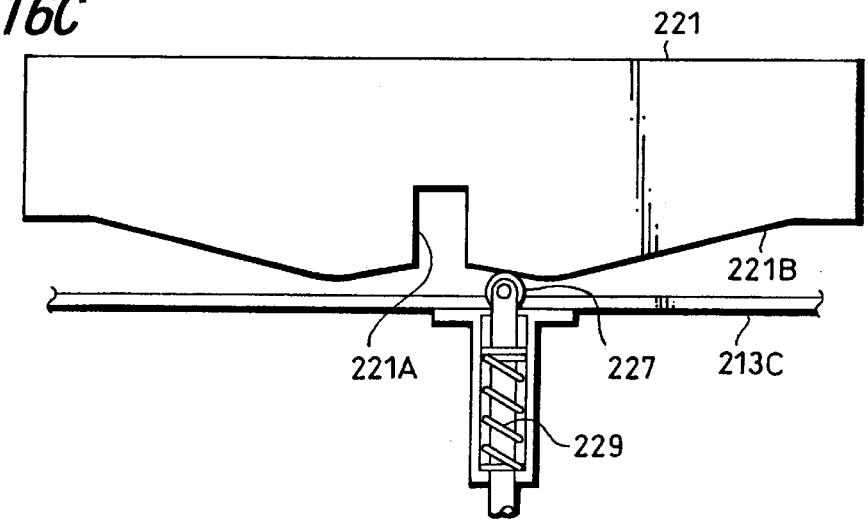

As shown in FIG. 16A, 16C, if the movable weight 221 is reciprocating at a relatively high speed, the wheel 227 does not engage with the concave portion 221A but jumps over the concave portion 221A so that it moves in the up-down direction along the curved line of the curved surface 221B. However, if the movable weight 221 is reciprocating at a relatively low speed, as shown in FIG. 16B, the wheel 227 engages with the concave portion 221A so that the movable weight 221 is halted.

A second example of the halt/fixing device of the anti-rolling apparatus will be described with reference to FIG. 17. A structure of the anti-rolling apparatus may be the same as that of the example shown in FIGS. 16A to 16C. This anti-rolling apparatus comprises two rail members 211, 211 supported by the supporting members 213A, 213B and the movable weight 221 capable of moving freely along the rail members 211, 211. The buffer rubbers 223A, 223B and the shock absorbers 224A, 224B are provided before and after the movable weight 221. The restoring force generating device for generating the restoring force for the movable weight 221 is provided although not shown.

A screw rod 231 is disposed in parallel to the rail members 211. The screw rod 231 is rotatably supported by the supporting members 213A, 213B on both sides. A handle 232 is mounted on an end of the screw rod 231. The screw rod 231 comprises a left-hand screw 231A and a right-hand screw 231B.

A left stopper member 233A and a right stopper member 233B are rotatably mounted on the left-hand screw portion 231A and the right-hand screw portion 231B of the screw portion 231. That is, the left-hand screw portion 231A of the screw rod 231 is inserted into a threaded hole in the left stopper member 233A and the right-hand screw portion 231B is inserted into a threaded hole in the right stopper member 233B.

The size in the radius direction of the left stopper member 233A and right stopper member 233B is so large that when they are rotated around the screw rod 231, they make contact with the rail member 211 and cannot be rotated further.

An operation of this halt/fixing device will be described. When the handle 232 is turned, the screw rod 231 is rotated. When the screw rod 231 is rotated, rotation moment due to friction is applied to the stopper members 233A, 233B which engage the respective screw portions 231A, 231B. However, the outside ends of the stopper members 233A, 233B make contact with the rail member 211, so that they are not rotated further.

A male screw of the left-hand screw portion 231A progresses relative to a female screw of the left stopper member 233A. The male screw of the right-hand screw portion 231B progresses relative to the female screw of the right stopper member 233B. Although the screw rod cannot move in the axial direction, the stopper members 233A, 233B are capable of moving in the axial direction. Thus, the stopper members 233A, 233B move with a progress of the screw.

The left stopper member 233A and right stopper member 233B progress in opposite direction to each other or in the direction toward the movable weight 221.

When the handle 232 is turned further, the stopper members 233A, 233B make contact with the back and forth ends of the movable weight 221 so that they support the movable weight 221 by nipping the back and forth ends thereof. Consequently, the reciprocating movable weight 221 is halted and fixed.

In the example of the halt/fixing device shown in FIG. 16, although the movable weight 221 cannot be halted when the speed thereof is relatively small, it cannot be halted if the speed thereof is relatively large. Further, when the wheel 227 passes the concave portion 221A in the movable weight 221 and engage the concave portion 221A, the wheel 227 strikes an entrance of the concave portion 221A. Due to that shock, the service life of a plunger mechanism supporting the wheel 227 is shortened.

Further, this halt/fixing device is not capable of fixing the movable weight 221 although it is capable of halting it. For example, if an object whose rolling is to be reduced rolls largely, the wheel 227 jumps over the concave portion 221A in the movable weight 221 as shown in FIG. 16C, so that there is a fear that the movable weight 221 may reciprocate again.

Figure 17:
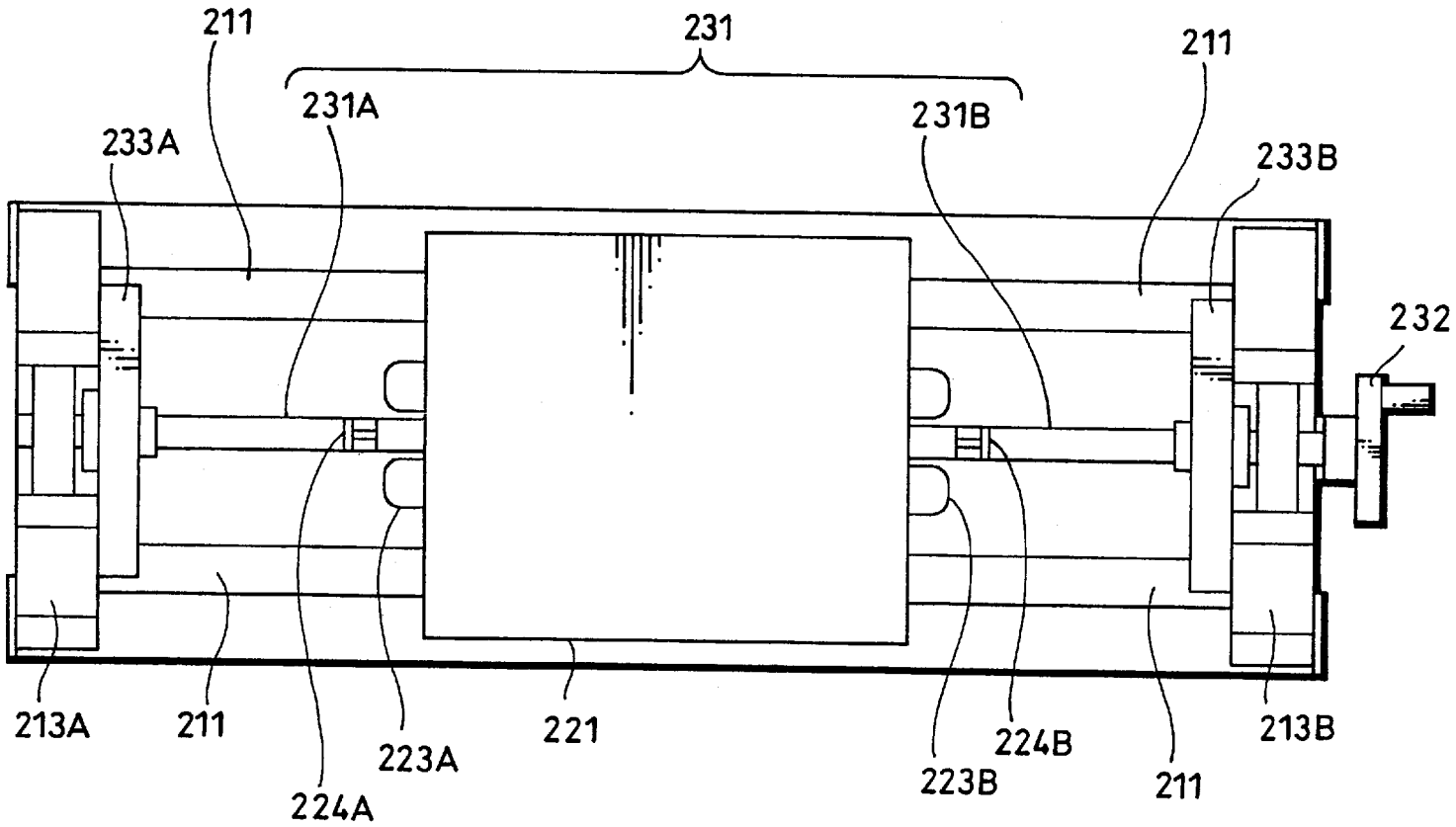
FIG. 17 is a diagram showing a second example of a halt/fixing device of the anti-rolling apparatus according to the present invention.

Because the halt/fixing device shown in FIG. 17 supports the movable weight 221 such that it is nipped from both sides by the stopper members 233A, 233B, it can halt the movable weight 221 and fix the halted movable weight 221. However, because the stopper members 233A, 233B are moved by means of screw, it takes a long time to stop the movable weight 221 completely.

Figure 18:
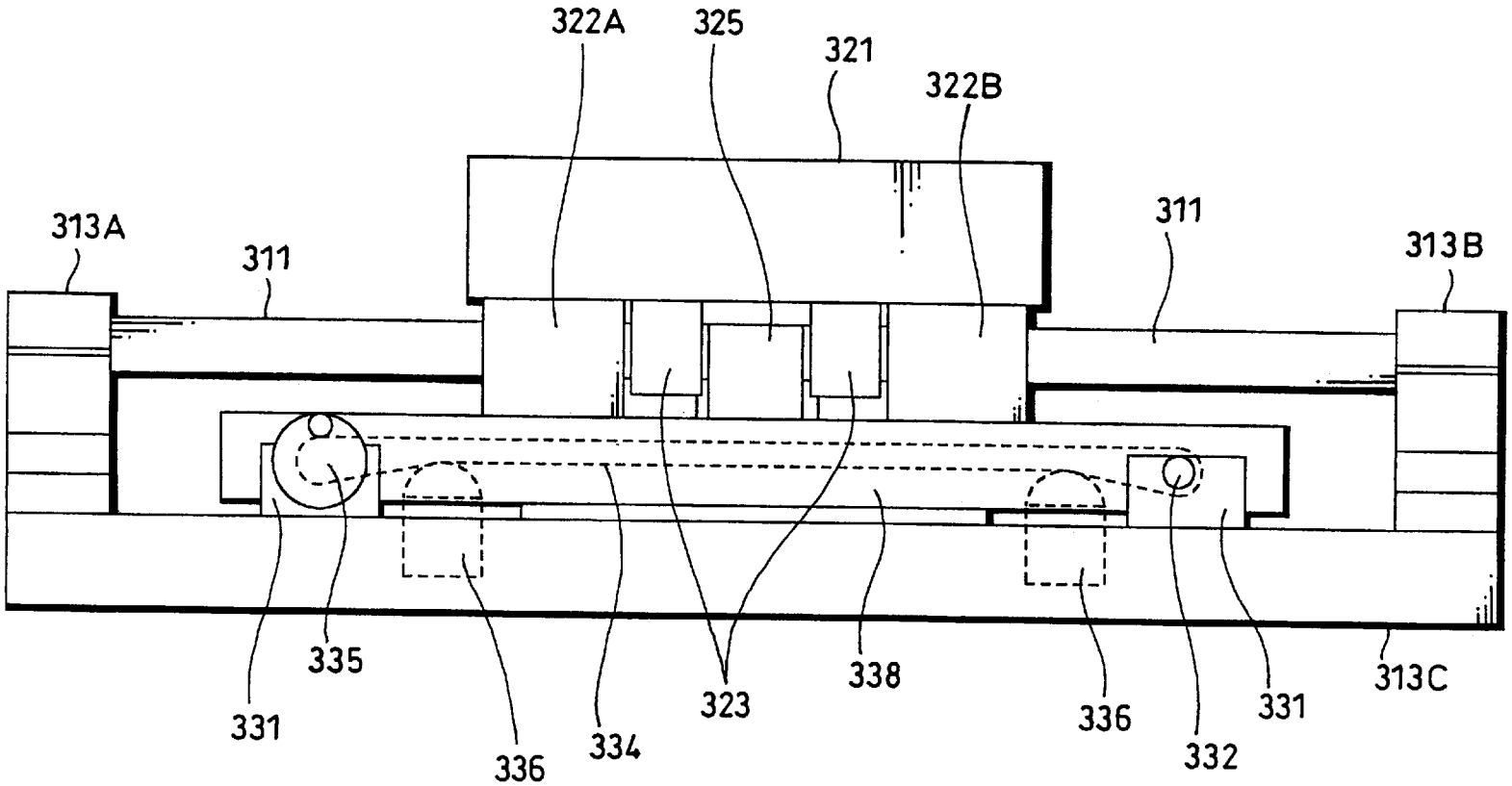
FIG. 18 is a diagram showing an arrangement of the anti-rolling apparatus according to the present invention.
Figure 19:
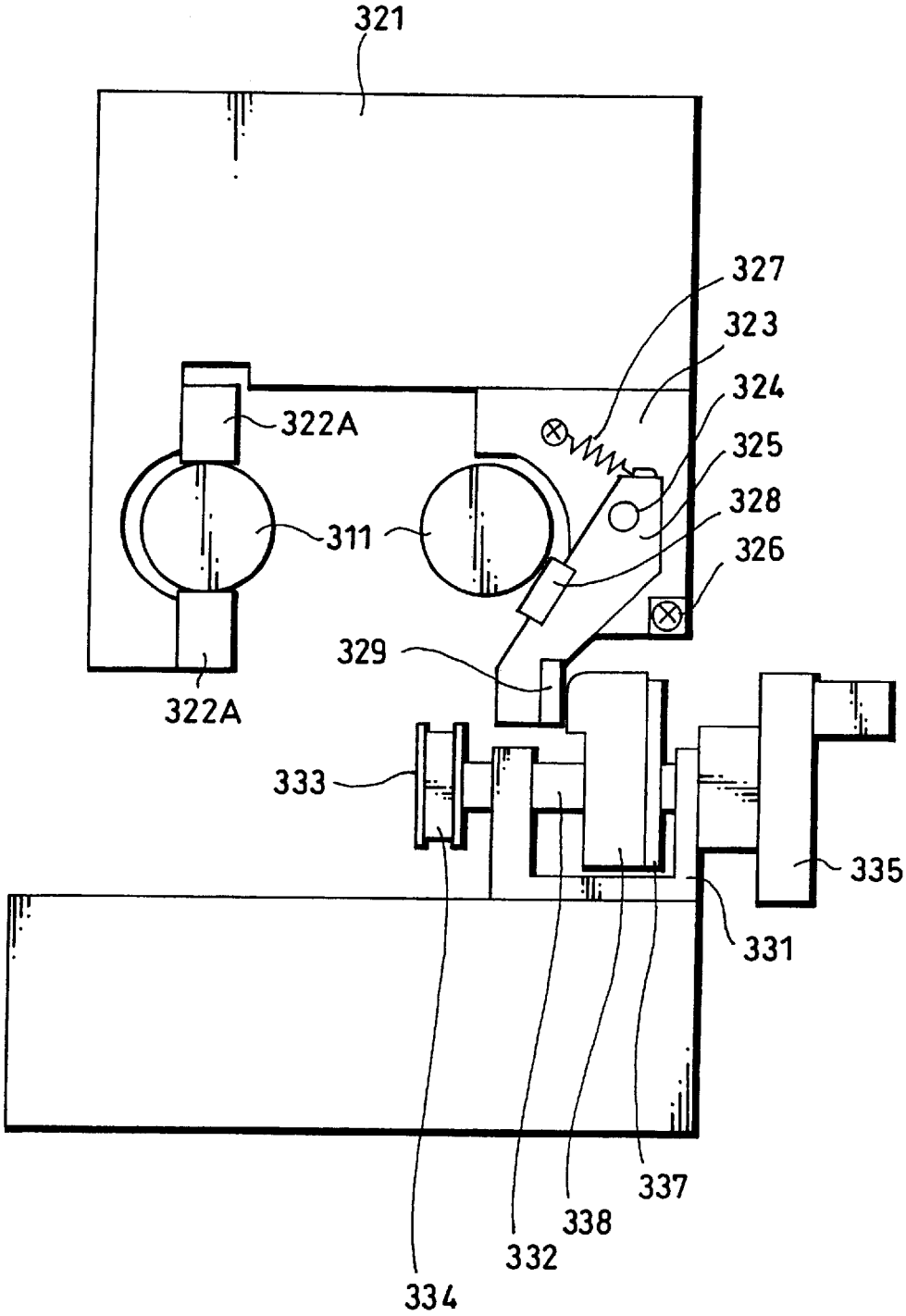
FIG. 19 is a partially cross-sectional view used to explain an arrangement of the halt/fixing device of the anti-rolling apparatus according to the present invention.

An embodiment of an anti-rolling apparatus according to the present invention will be described with reference to FIGS. 18, 19. The anti-rolling apparatus of the present embodiment comprises two rail members 311, 311 (FIG. 19), a movable weight 321 capable of moving freely along the rail members 311, 311 and supporting members 313A, 313B supporting the rail members 311, 311 on both sides. The movable weight 321 has a pair of direct-acting bearings 322A, 322B and inside faces of the direct-acting bearings 322A, 322B engage the rail member 311.

The anti-rolling apparatus is equipped with a restoring force generating device for generating a restoring force for the movable weight 321. The restoring force generating device may be a device comprising springs mounted on both sides of the movable weight 321, though not shown.

Next, a halt/fixing device provided on the anti-rolling apparatus according to the present embodiment will be described. The halt/fixing device of the present embodiment comprises, as shown in FIG. 19, a hinge supporting base 323, a brake hinge 325 pivotally supported by a hinge shaft 324, a hinge stopper 326 and a hinge restoring spring 327. The hinge brake 325 is provided with two friction materials 328, 329.

These components 323, 324, 325, 326, 327, 328, 329 compose a movable portion which is movable together with the movable weight 321. As shown in FIG. 18, the brake hinge 325 is supported by two hinge supporting bases 323 and the brake hinge 325 may be mounted between the two hinge supporting bases 323 so as to be capable of pivoting around the hinge shaft 324.

On the other hand, two supporting members 331 are mounted on a bottom member 313C of the anti-rolling apparatus. The two supporting members 331 are located separately with a sufficient distance therebetween so that they are adjacent to the supporting members 313A, 313B on both sides of the anti-rolling apparatus. As shown in FIG. 19, a trapezoidal screw thread 332 is rotatably mounted on each of the two supporting members 331. A timing pulley 333 is mounted on an inside end of the trapezoidal screw thread 332 and a timing belt 334 is wound around the two timing pulleys 333. It is permissible to mount tensioners 336 (FIG. 18) for applying a predetermined tension to the timing belt 334 between the two supporting members 331. A handle 335 is mounted on an outside end of one trapezoidal screw thread 332.

A trapezoidal nut 337 is mounted on each of the trapezoidal screw thread 332 and a slide supporting member 338 is mounted on the trapezoidal nuts 337. As shown in FIG. 18, this slide supporting member 338 has a dimension extending out of the two trapezoidal screw threads 332. Two trapezoidal screw threads 332 are inserted through two holes provided in the slide supporting member 338.

Then, the operation of this halt/fixing device will be described with reference to FIGS. 19, 20. When the handle 335 is turned, the trapezoidal screw thread 332 of a side in which this handle 335 is mounted is rotated, so that the timing pulley 333 on the inside end is rotated. This rotation of the timing pulley 333 is transmitted to the trapezoidal screw thread 332 of the other side through the timing belt 334. That is, when the handle 335 is turned, the two trapezoidal screw threads 332 are rotated synchronously.

Because the two trapezoidal screw threads 332 are in engagement with the trapezoidal nuts 337, when the trapezoidal screw threads 332 are rotated, the trapezoidal screw threads 332 are about to progress in a direction of screw advancement relative to the trapezoidal nuts 337. However, the trapezoidal screw threads 332 are supported by the supporting members 331 so that they are rotatable, however they cannot progress in the direction of the screw advancement. Thus, the trapezoidal nuts 337 progress in a direction opposite to the screw advancement. As a result, the slide supporting member 338 mounted on the trapezoidal nuts 337 is moved.

Figure 20A:
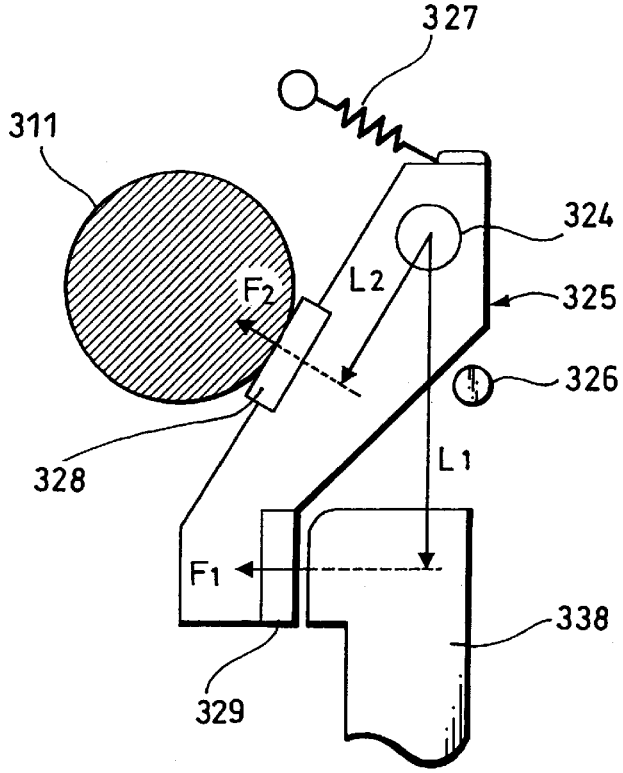
FIGS. 20A and 20B are diagrams used to explain an arrangement of the halt/fixing device of the anti-rolling apparatus according to the present invention.
Figure 20B:
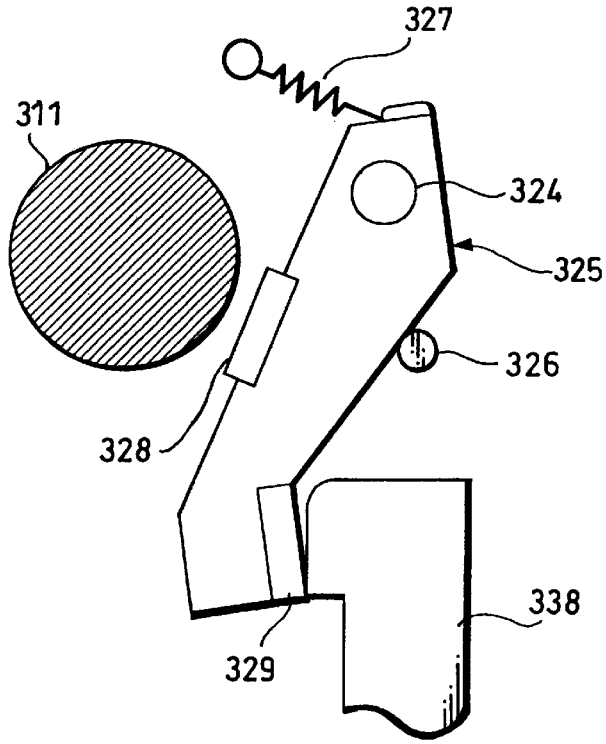

FIGS. 20A and 20B will be explained. FIG. 20A shows a state in which the slide supporting member 338 is in the forward position and the brake hinge 325 is in the frictional engagement position so that the halt/fixing device is actuated. FIG. 20B shows a state in which the slide supporting member 338 is in the backward position and the brake hinge 325 is in the friction releasing position so that the halt/fixing device is not actuated.

The brake hinge 325 is pivotal around the hinge shaft 324 and moves between the frictional engagement position shown in FIG. 20A and the friction releasing position shown in FIG. 20B. The hinge restoring spring 327 is mounted on a top end of the brake hinge 325 such that the brake hinge 325 is urged so as to rotate in clockwise direction or a direction toward the friction releasing position. However, the brake hinge 325 is blocked from rotating further in the clockwise direction by the hinge stopper 326.

Of the friction materials 328, 329 mounted on the brake hinge 25, the friction material 328 mounted inside is disposed so as to engage the rail member 311. The friction material 329 mounted outside is disposed so as to engage the inside end of the slide supporting member 338. By friction forces generated by the two friction materials 328, 329, the movable weight 321 is braked. The friction materials 328, 329 are formed of an appropriate material and replaceably mounted.

The halt/fixing device of the present embodiment has a halting function for halting the movable weight 321 and a fixing function for fixing the halted movable weight 321. First, the halting function will be explained. During use of the anti-rolling apparatus, the slide supporting member 338 is in the backward position as shown in FIG. 20B because the halt/fixing device is not used, and the brake hinge 325 is in the friction releasing position. Thus the movable weight 321 is moved along the rail member 311.

When it is intended to halt the movable weight 321, the handle 335 is turned so as to move the slide supporting member 338 up to the forward position as shown in FIG. 20A. The brake hinge 325 pivots around the hinge shaft 324 so that it is moved up to the friction engagement position. As a result, the movable weight 321 is halted.

Next, the fixing function will be explained. The slide supporting member 338 is not moved spontaneously from the forward position to the backward position unless the handle 335 is turned.

When the movable weight 321 is halted and fixed as shown in FIG. 20A, a predetermined pressing force $F_2$ is applied to the movable weight 321 by the brake hinge 325. On the contrary, a reaction is applied from the movable weight 321 to the brake hinge 325. This reaction acts so as to move the slide supporting member 338 outward or toward the backward position. However, even if the force directing to the backward position is applied to the slide supporting member 338, the trapezoidal nut 337 is not rotated around the trapezoidal screw thread 332.

When the anti-rolling apparatus is used again, an operation opposite to the above manner is carried out. The handle 335 is turned in an opposite direction so as to move the slide supporting member 338 from the backward position to the forward position. Consequently, the brake hinge 325 is moved from the friction engagement position shown in FIG. 20A to the friction releasing position shown in FIG. 20B.

The braking force generated by the halt/fixing device of the present embodiment will be considered. The braking force is generated by friction force. The friction force is proportional to a force applied to each of the friction materials 328, 329 or the pressing force. In the halt/fixing device of the present embodiment, the pressing force is enhanced by a lever action of the brake hinge 325. The pressing force acting upon the friction materials 328, 329 produces a rotary moment for rotating the brake hinge 325 around the hinge shaft 324.

As shown in FIG. 20A, a rotary moment $F_2 \times L_2$ of the pressing force $F_2$ by the inside friction material 328 is equal to the rotary moment $F_1 \times L_1$ by the pressing force $F_1$ applied to the outside friction material 329. Thus, the pressing force $F_2$ by the inside friction material 328 can be expressed as follows.

$$F_2 = F_1 \times (L_1/L_2) \tag{12}$$

where $L_1$, $L_2$ are distances from a central axis of the hinge shaft 324 up to the respective pressing forces $F_1$, $F_2$. The distances $F_1$, $F_2$ correspond to distances from the hinge shaft 324 to the respective friction materials 328, 329. The pressing force $F_1$ acting on the outside friction material 329 is generated by turning the handle 335 and is assumed to be substantially constant. Thus, by adjusting a ratio of the distance $L_1$ to $L_2$ or $L_1/L_2$, a desired friction force $F_2$ can be obtained. This ratio $L_1/L_2$ is designed so as to be larger than 1.

$$L_1/L_2 > 1 \tag{13}$$

Consequently, the pressing force $F_1$ acting on the outside friction material 329 is increased by the lever action of the brake hinge 325 and transmitted in the form of the pressing force $F_2$ by the inside friction material 328. The lever action is adjusted by adjusting the ratio $L_1/L_2$.

According to the present embodiment, the brake hinge 25 is designed so that the distances from the central axis of the hinge shaft 324 to the respective pressing forces $F_1$, $F_2$ satisfy the above expression. Therefore the distance from the hinge shaft 324 to the inside friction material 28 is designed so as to be smaller than the distance from the hinge shaft 24 to the outside friction material 329.

According to the present invention, it is possible to halt and fix the movable weight securely without any shock.

According to the present invention, it is possible to halt and fix the movable weight even if the movable weight is located at any position on the rail.

According to the present invention, no shock is given to the movable weight when it is halted. Thus, the service lives of the anti-rolling apparatus and halt/fixing device are extended.

According to the present invention, it is possible to halt and fix the movable weight by only the handle. Thus, the halt/fixing operation can be carried out simply and quickly.

According to the present invention, it is possible to halt and fix the movable weight continuously and substantially at the same time.

Figure 21A:
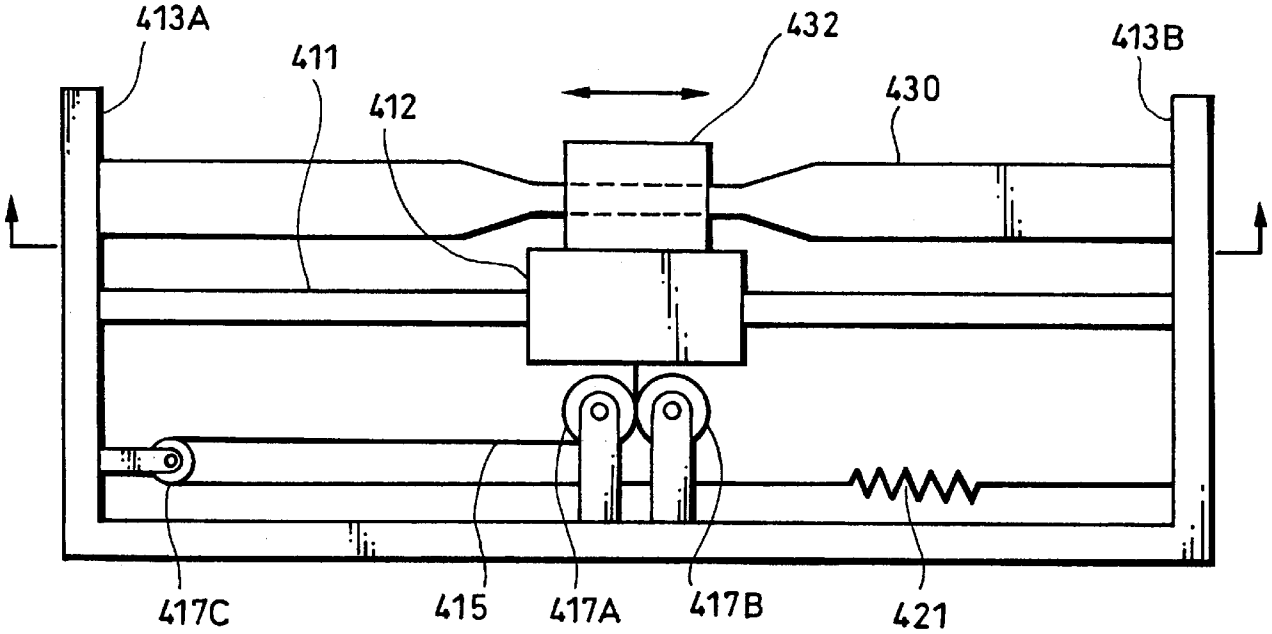
FIGS. 21A and 21B are diagrams showing an arrangement of the anti-rolling apparatus according to the present invention.
Figure 21B:
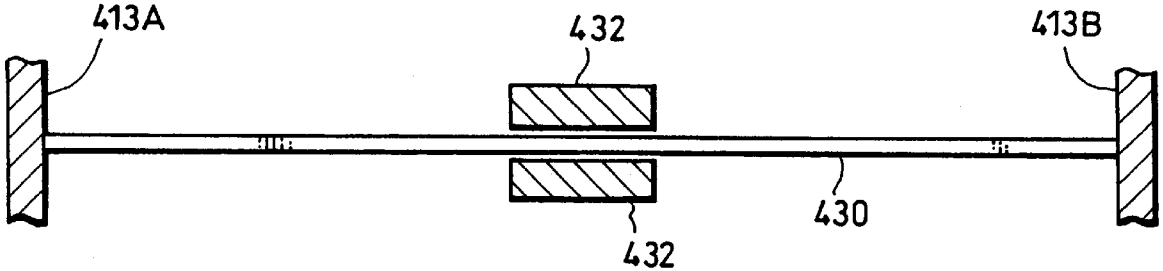

An embodiment of an anti-rolling apparatus according to the present invention will be described with reference to FIGS. 21A and 21B. The anti-rolling apparatus of the present invention comprises a rail member 411, a movable weight 412 capable of freely moving along the rail member 411, supporting members 413A, 413B for supporting the rail member 411 on both sides, and a wire 415 attached to the movable weight 412. The wire 415 is guided by rollers 417A, 417B, and 417C. The wire 415 is connected to a spring 421 and the other end of the spring 421 is connected to the supporting member 13B.

Figure 2:
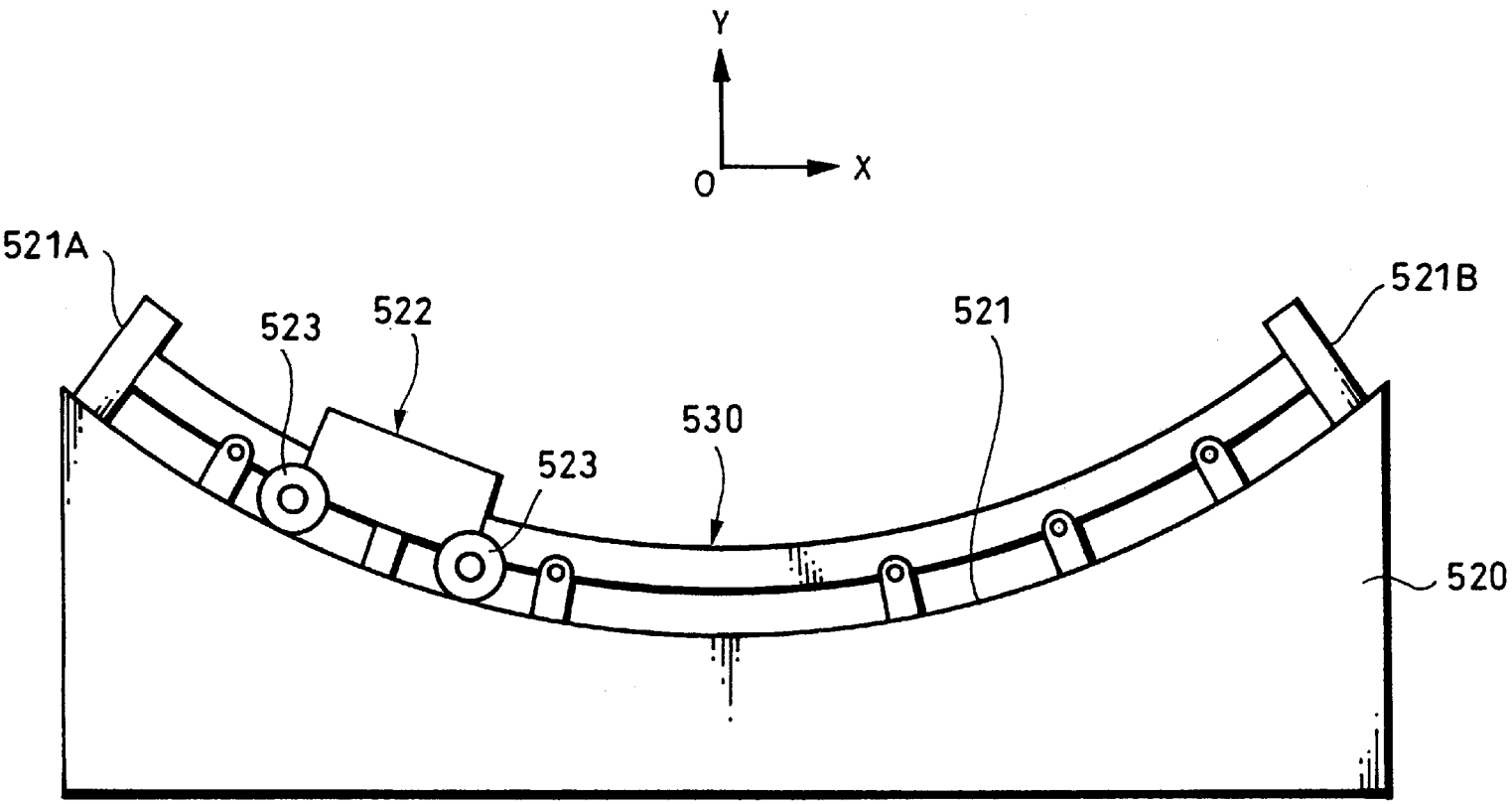
FIG. 2 is a diagram showing a second example of the conventional anti-rolling apparatus.
Figure 3:
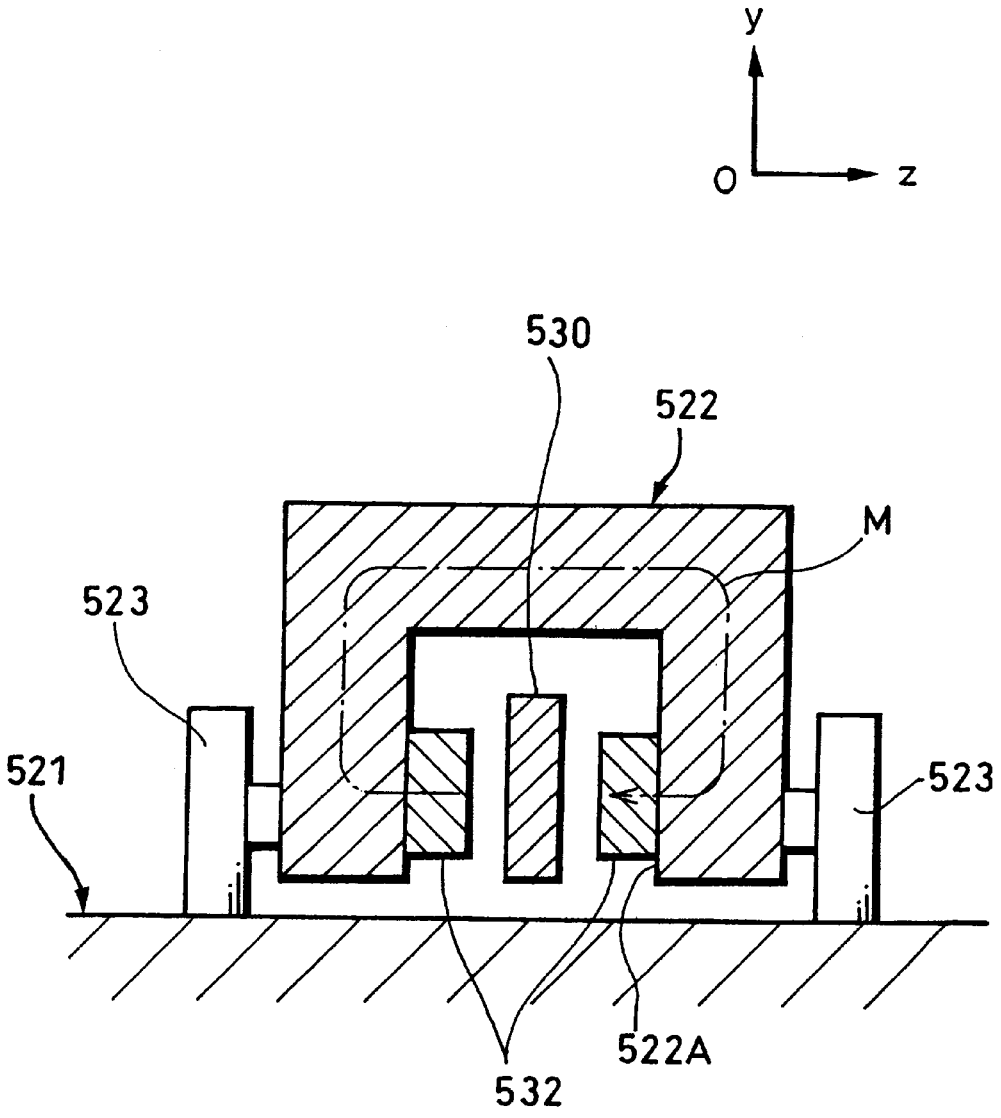
FIG. 3 is a diagram showing an arrangement of a magnetic damper of the conventional anti-rolling apparatus by way of example.
Figure 4:
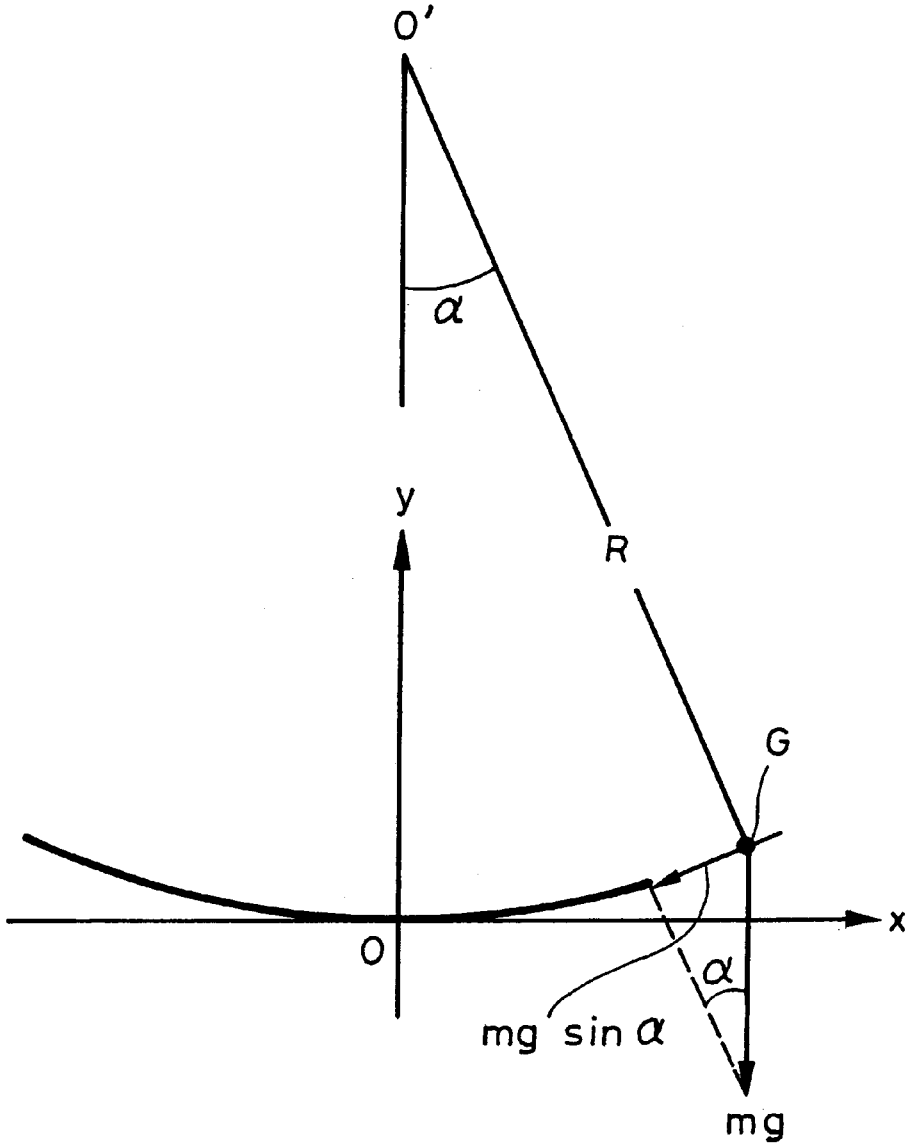
FIG. 4 is a diagram used to explain a restoring force of the conventional anti-rolling apparatus.

In the anti-rolling apparatus of this embodiment, the spring 421 attached to the movable weight 412 generates a restoring force. Comparing the anti-rolling apparatus of this embodiment with a conventional anti-rolling apparatus, the conventional anti-rolling apparatus shown in FIG. 2 is so constructed that a rail face 521 is formed in a circular form so that a component in the direction of tangent line of the gravity acting on the movable weight 412 generates a restoring force. However, the anti-rolling apparatus of this embodiment is different from the conventional example in that the restoring force is generated by an elastic force of a spring 21.

Figure 22:
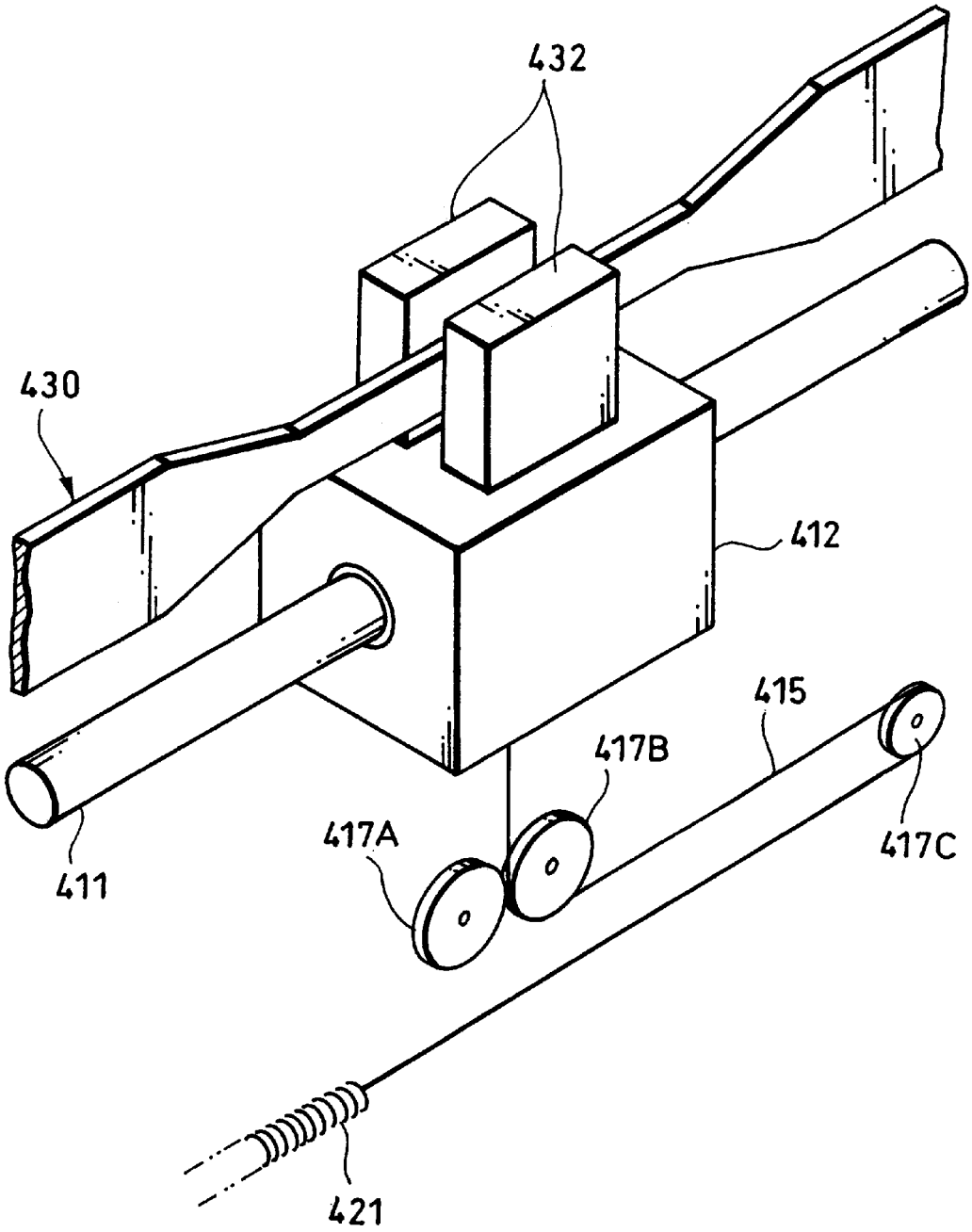
FIG. 22 is a diagram showing an arrangement of the magnetic damper of the anti-rolling apparatus according to the present invention.

Referring to FIG. 22, a structure of a magnetic damper in the anti-rolling apparatus of this embodiment will be described. The magnetic damper in the anti-rolling apparatus of this embodiment contains an electric conductor member 430 disposed so as to extend in parallel to the rail member 411 and permanent magnets 432, 432 mounted on the movable weight 412.

Assume that a central point of reciprocating motion of the movable weight 412 is an origin 0. The restoring force by the spring 421 is only initial tensile force. In the magnetic damper of the present example, the electric conductor member 430 is made of a belt-like member. The width of the belt-like member is narrow in the vicinity of the origin 0 and the width thereof increases as it is farther from the origin 0.

Figure 23A:
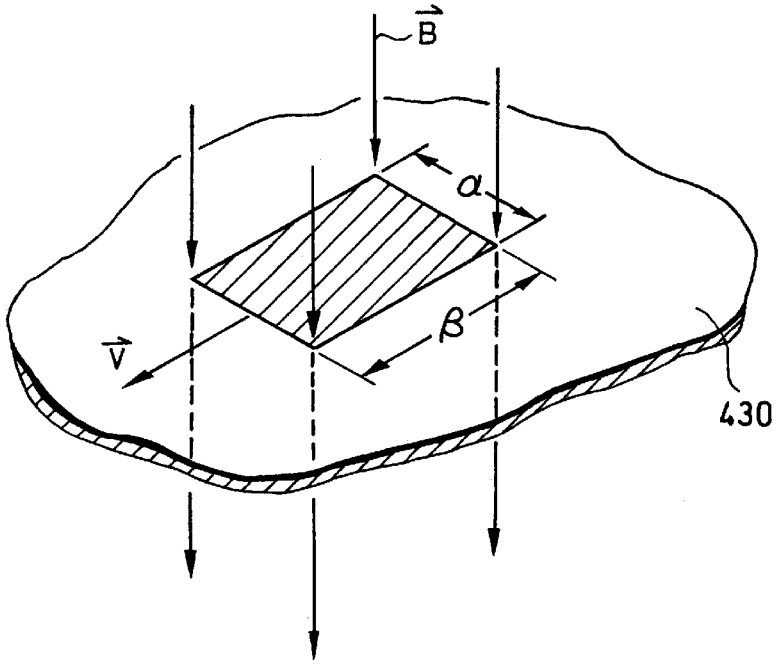
FIGS. 23A and 23B are diagrams used to explain a form factor used for generating a damping force of the magnetic damper.
Figure 23B:
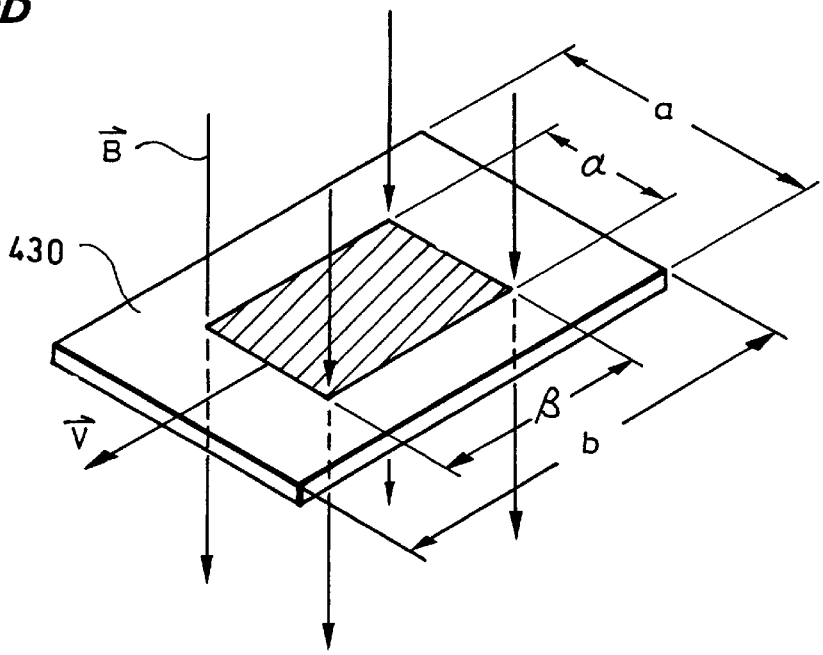

FIGS. 23A and 23B will be explained. Assume that magnetic flux having magnetic flux density B passes an infinitely wide electric conductor member 430 as shown in FIG. 23A. The magnetic flux has a rectangular cross section in which a longitudinal length is $\alpha$ and a lateral length is $\beta$. When this magnetic flux moves at a speed v, a force F acting on the permanent magnets generating the magnetic flux can be expressed as follows.

$$F=Cv \tag{14}$$

where C indicates a damping coefficient for specifying a damping force of the magnetic damper, which is expressed as follows.

$$C=C_0(B^2\ ta\beta)/\rho \tag{15}$$

where $C_0$ is form factor of magnetic field, B is magnetic flux, t is thickness of electric conductor member 430 and $\rho$ is specific resistance of the electric conductor member 430. When the electric conductor member 430 is infinitely wide as shown in FIG. 23A, the form factor of magnetic field can be expressed as follows.

$$C_0=(1/\pi)[2\tan^{-1}\beta+(\gamma/2)ln(1+\gamma^{-2})-(\gamma^{-1}/2)/ln(1+\gamma^2)] \tag{16}$$

where $\gamma=\alpha/\beta$. In a case when the electric conductor member 430 is not infinitely wise but a rectangle in which a longitudinal length thereof is a and a lateral length thereof is b, it can be expressed as follow.

$$C_0 = 1 - \frac{\beta}{b} - \frac{b^2}{\pi^3\alpha\beta}\sum_{n=1}^{\infty}\frac{(1-e^{-2n\pi\alpha/b})(1+e^{-2n\pi(a-\alpha)/b})}{n^3(1+e^{-2n\pi\alpha/b})}\sin^2(n\pi\beta/b) \tag{17}$$

As indicated by the above two Expressions, generally the form factor $C_0$ of magnetic field is a function of cross section $\alpha\beta$ of magnetic flux passing the electric conductor member 430. The larger the cross section $\alpha\beta$ of magnetic flux, the larger the form factor $C_0$ of magnetic field becomes. If the cross section $\alpha\beta$ of magnetic flux is small, the form factor $C_0$ of magnetic field decreases.

To adjust the damping force of the magnetic damper, the damping coefficient C is changed. The damping coefficient C is a function of the form factor $C_0$ and changes depending on the cross section of magnetic flux. Consequently, to change the damping force of the magnetic damper, the cross section $\alpha\beta$ of magnetic flux is changed.

According to the present invention, of magnetic flux generated by two permanent magnets 432, 432, the cross section of magnetic flux passing the electric conductor member 430 is changed. As shown in FIGS. 21, 22, the width of the electric conductor member 430 is narrow in the vicinity of the origin O and the width thereof is wide as it is far from the origin O. Therefore, when the movable weight 412 is located in the vicinity of the origin O, the damping coefficient C is small. If the movable weight 412 is moved to either side from the origin, the damping coefficient C is increased.

Examples of the shapes of the electric conductor member 430 will be described with reference to FIGS. 24A to 24E. The electric conductor member 430 is constricted in the central portion including the origin O. Apart from the origin O, the width is wide. In an example shown in FIG. 24B, although the electric conductor member 430 is constricted in the central portion including the origin O, reinforcement portions 430A made of nonconductive material are provided to prevent reduction of the strength.

Figures 24A, 24B, 24C, 24D, 24E, 24F:
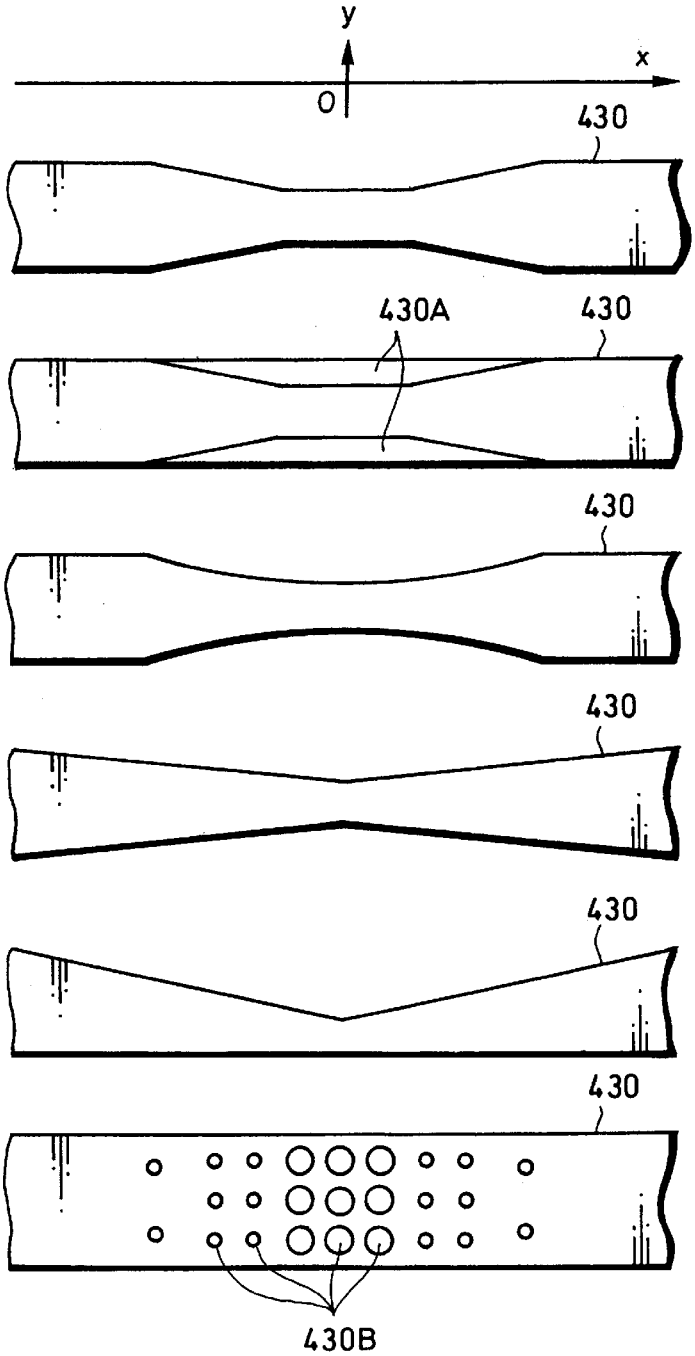
FIGS. 24A to 24F are diagrams showing an example of a conductive member according to the present invention.

In an example shown in FIG. 24C, the width of the electric conductor member 430 is reduced in a curved shape in the central portion including the origin O. In an example shown in FIG. 24D, the width of the electric conductor member 30 changes linearly on both sides of the origin O. In an example shown in FIG. 24E, although the width of the electric conductor member 430 changes linearly on both sides of the origin O, an edge of one side is straight while that of the other side changes.

In the examples shown in FIGS. 24C–24E, it is permissible to provide both sides of a portion in which the width of the electric conductor member 430 narrows like the example shown in FIG. 24B, with the reinforcement portion 430A. In an example shown in FIG. 24F, although the width of the electric conductor member 430 is predetermined, the electric conductor member 430 is provided with holes 430B. In the vicinity of the origin O, holes 430B having a large diameter are provided and far from the origin O, holes 430B having a small diameter are provided.

It is permissible to provide a plurality of the holes having the same diameter and distribute them so that the density of the holes changes. For example, the density of the holes 430B is increased in the vicinity of the origin O and the density thereof is decreased as they are farther from the origin 0. As a result, a substantial cross section of magnetic flux passing the electric conductor member 430 is decreased in the vicinity of the origin O, while the substantial cross section of magnetic flux passing the electric conductor member 430 is increased on both far sides of the origin O.

According to the present example, by changing the shape of the electric conductor member 430, the cross section of magnetic flux substantially passing the electric conductor member 30 is changed, so that the damping coefficient C of the magnetic damper is changed.

According to the present invention, the damping coefficient C of the magnetic damper is changed corresponding to a displacement of the movable weight 412. For example, it is permissible to utilize an electric magnet instead of the permanent magnets 432A, 432B so as to change a magnetic field or magnetic flux caused by the electric magnet. For example, by changing a current flowing through a coil forming the electric magnet, it is possible to change the magnetic field or magnetic flux caused by the electric magnet.

Figure 25:
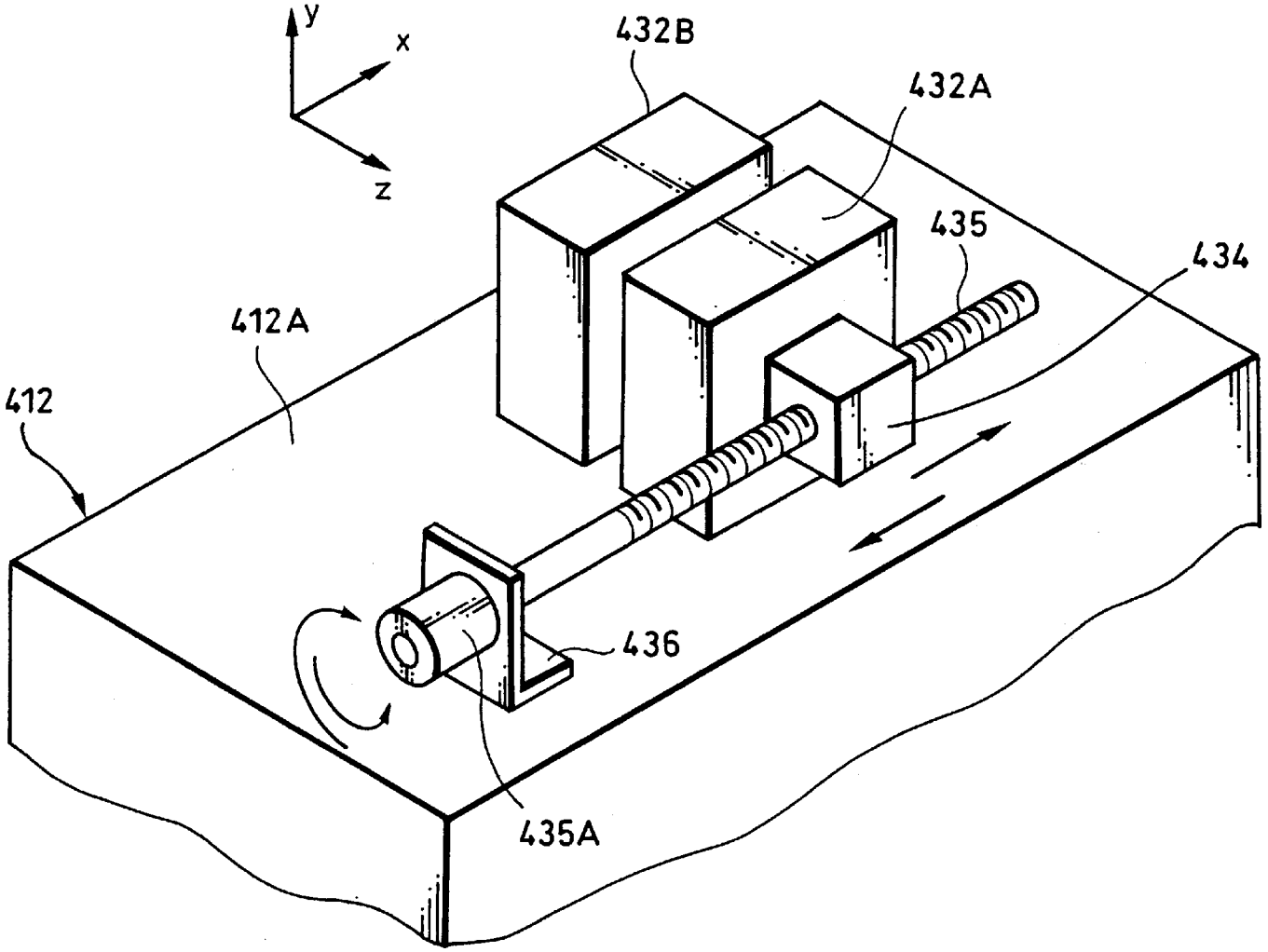
FIG. 25 is a diagram showing another example of the magnetic damper of the anti-rolling apparatus according to the present invention.

FIG. 25 will be explained. FIG. 25 shows a pair of the permanent magnets 432A, 432B provided on a top face 412A of the movable weight 412. In this example, although one permanent magnet 432B is fixed on the top face 412A of the movable weight 412, the other permanent magnet 432A can move on the top face 412A of the movable weight 412.

Assume that the two permanent magnets 432A, 432B are of the same shape and same dimension. When the two permanent magnets 432A, 432B are disposed so that they are in parallel to each other and match each other along the z-axis, the strongest magnetic field or magnetic flux is generated between the both members. However, when the two permanent magnets 432A, 432B are disposed so that they are displaced relative to the z-axis, the magnetic field or magnetic flux generated between the two members changes or decreases.

In the present example, a block 434 having female screw is mounted on the movable permanent magnet 432A and a male screw 435 is inserted through the female screw in this block 434. A head portion 435A of this male screw 435 is supported rotatably by means of a supporting member 436. By rotating the head portion 435A of the male screw 435, the female screw in the block 434 and the male screw 435 are moved relative to each other corresponding to a progress of the screw. Because the male screw 435 cannot be moved in the axial direction because of the supporting member 436, the block 434 is moved. Thus, the permanent magnet 432A is moved on the top face 412 of the movable weight 412.

When the movable permanent magnet 432A is moved relative to the fixed permanent magnet 432B, the magnetic field or magnetic flux generated by both is changed so as to change the damping force of the magnetic damper. Therefore, for example, in a case when the installation height of the anti-rolling apparatus relative to a rolling center of an object whose rolling is to be reduced is high or the weight of the object is large, the two permanent magnets 432A, 432B are disposed so that they match each other along the z-axis so as to produce a maximum damping force.

On the contrary, in a case when the installation height of the anti-rolling apparatus relative to the rolling center of the object is low or the weight of the object is small, the two permanent magnets 432A, 432B are disposed so that they are displaced with respect to the z-axis so as to produce a relatively small damping force.

Meantime, the permanent magnets 432A, 432B explained with reference to FIG. 25 may be applied to the electric conductor member 430 shown in FIG. 24.

Because, according to the present invention, the damping coefficient of the magnetic damper changes depending on a position of the movable weight, it is possible to achieve an optimum anti-rolling effect for the object whose rolling is to be reduced.

According to the present invention, when the rolling angle of the object is large, a relatively large damping force is produced, and when the rolling angle of the object is small, a relatively small damping force is produced. Therefore it is possible to achieve an optimum anti-rolling effect for the object.

According to the present invention, the damping force of the magnetic damper can be adjusted. Thus, it is possible to achieve a desired anti-rolling effect.

According to the present invention, the damping force of the magnetic damper can be adjusted. Therefore, when the installation height of the anti-rolling apparatus relative to the rolling center of the object changes or the weight thereof changes, it is possible to achieve a desired anti-rolling effect.

Having described preferred embodiments of the present invention with reference to the accompanying drawings, it is to be understood that the present invention is not limited to the above-mentioned embodiments and that various changes and modifications can be effected therein by one skilled in the art without departing from the spirit or scope of the present invention as defined in the appended claims.

What is claimed is:

1. An anti-rolling apparatus comprising rail members which are formed in straight form and disposed perpendicular to a rolling axis of an object whose rolling is to be reduced, a movable weight capable of reciprocating along said rail members, said movable weight having a monolithic body and at least one incorporated portion extending into said monolithic body, said incorporated portion terminating in an inner wall spaced from an outer surface of said body, two springs connected directly to the movable weight for exerting a transverse restoring force directly to said movable weight, at least one of said springs attached to said inner wall, wherein said two springs are elongated or contracted alternately when said movable weight is reciprocated.

2. An anti-rolling apparatus according to claim 1 wherein when one of said two springs is elongated, the other thereof is contracted.

3. An anti-rolling apparatus according to claims 1, or 2 wherein a natural oscillation cycle of said movable weight can be changed by changing spring constants of said two springs.

4. An anti-rolling apparatus according to claim 1, further comprising shock absorbers for relaxing a shock which may occur when said movable weight is forcibly stopped.

5. An anti-rolling apparatus comprising rail members which are formed in straight form and disposed perpendicular to a rolling axis of an object whose rolling is to be reduced, a movable weight capable of reciprocating along said rail members, two wires are connected to said movable weight and two springs are connected to the other ends of said wires such that said wires are guided by means of roller members and wherein said two springs are elongated or contracted alternately when said movable weight is reciprocated.

6. An anti-rolling apparatus characterized in that the anti-rolling apparatus comprises a movable weight able to be reciprocated along a predetermined orbit, said movable weight having a monolithic body and at least one incorporated portion extending into said monolithic body, said incorporated portion terminating in an inner wall interiorly spaced from an outer surface of said body, a restoring force generator for generating a restoring force to said movable weight including at least one spring connected to said inner wall, and springs for stoppers arranged at both ends of said orbit, and is constructed such that kinetic energy of said movable weight is accumulated by the springs for stoppers.

7. The anti-rolling apparatus as claimed in claim 6, wherein buffer rubbers are arranged at both the ends of said orbit.

8. The anti-rolling apparatus as claimed in claim 6, wherein a damper is arranged for generating a damping force in aid movable weight.

9. An anti-rolling apparatus comprising a rail member supported by supporting members, a movable weight capable of reciprocating along said rail member, a restoring force generating device for generating a restoring force for said movable weight, and a halt/fixing device for halting and fixing said movable weight, wherein said halt/fixing device contains a brake hinge mounted on said movable weight and slide supporting member which is mounted on said supporting members and disposed so as to extend along said rail member, said brake hinge being moved between a friction engagement position in which it fictionally engages with said rail member and a friction releasing position in which the frictional engagement with said rail member is released, by moving said slide supporting member.

10. The anti-rolling apparatus according to claim 9 wherein said brake hinge is capable of pivoting around a pivoting shaft and contains a first friction material for fictionally engaging with said rail member and a second friction material for fictionally engaging with said slide supporting member, a distance from said first friction material to said pivoting shaft being smaller than a distance from said second friction material to said pivoting shaft.

11. The anti-rolling apparatus according to claim 9 or 10 wherein said brake hinge is displaced in a direction to said friction releasing position by means of a releasing spring.

12. The anti-rolling apparatus according to claim 9, or 10 wherein a screw thread is rotatably supported by said supporting member and a nut fixed to said slide supporting member is mounted on said screw thread so that, when a handle which is mounted on one end of said screw is turned, said nut is moved with respect to said screw thread, thereby said slide supporting member being moved.

13. An anti-rolling apparatus comprising a movable weight capable of reciprocating along a predetermined rail, a restoring force generating device for generating a restoring force for said movable weight, and a magnetic damper for generating a damping force for said movable weight, wherein said magnetic damper includes an electric conductor member extended along said rail and permanent magnets mounted on said movable weight and wherein a damping coefficient of the damping force generated by said magnetic damper is changed along said rail.

14. The anti-rolling apparatus according to claim 13 wherein a cross section of magnetic flux passing said electric conductor member of magnetic flux generated by said permanent magnets is changed along said rail.

15. The anti-rolling apparatus according to claim 13 or 14 wherein said electric conductor member is made of a belt-like member and a width of said belt-like member is changed along said rail.

16. The anti-rolling apparatus according to claim 13 or 14 wherein said electric conductor member is made of a belt-like member and said belt-like member contains a plurality of holes so that a cross section of magnetic flux passing said electric conductor member is changed by said holes.

17. An anti-rolling apparatus comprising a movable weight capable of reciprocating along a predetermined rail, a restoring force generating device for generating a restoring force for said movable weight, and a magnetic damper for generating a damping force for said movable weight, wherein said magnetic damper contains a fixed permanent magnet fixed on said movable weight and a movable permanent magnet which can be moved relative to said movable weight, so that magnetic field or magnetic flux generated by said two permanent magnets can be changed by changing a relative position of said movable permanent magnet and wherein a damping coefficient of the damping force generated by said magnetic damper is changed.

* * * * *